US010590772B1

(12) United States Patent
Parker et al.

(10) Patent No.: US 10,590,772 B1
(45) Date of Patent: Mar. 17, 2020

(54) SECOND STAGE TURBINE BLADE

(71) Applicant: Chromalloy Gas Turbine LLC, Palm Beach Gardens, FL (US)

(72) Inventors: David G. Parker, Jupiter, FL (US); Zhenhua Xiao, Palm Beach Gardens, FL (US); Richard Yu, Wellington, FL (US); Vincent C. Martling, Wellington, FL (US); Paul Gregory Herber, Royal Palm Beach, FL (US); James Page Strohl, Stuart, FL (US)

(73) Assignee: CHROMALLOY GAS TURBINE LLC, Palm Beach Gardens, FL (US)

( * ) Notice: Subject to any disclaimer, the term of this patent is extended or adjusted under 35 U.S.C. 154(b) by 36 days.

(21) Appl. No.: 16/107,401

(22) Filed: Aug. 21, 2018

(51) Int. Cl.

| | |
|---|---|
| ***F01D 5/14*** | (2006.01) |
| ***F01D 5/30*** | (2006.01) |
| ***F01D 25/04*** | (2006.01) |
| ***F01D 5/22*** | (2006.01) |
| ***F01D 25/06*** | (2006.01) |
| ***F01D 5/16*** | (2006.01) |

(52) U.S. Cl.
CPC ..... *F01D 5/142* (2013.01); *F01D 5/141* (2013.01); *F01D 5/143* (2013.01); *F01D 5/16* (2013.01); *F01D 5/225* (2013.01); *F01D 5/3007* (2013.01); *F01D 25/04* (2013.01); *F01D 25/06* (2013.01); *F05D 2220/32* (2013.01); *F05D 2240/301* (2013.01); *F05D 2240/80* (2013.01); *F05D 2250/74* (2013.01); *Y10S 416/02* (2013.01)

(58) Field of Classification Search
CPC . F01D 5/14; F01D 5/141; F01D 5/142; F01D 5/143; F01D 5/16; F01D 5/22; F01D 5/225; F01D 25/04; F01D 25/06; F05D 2220/32; F05D 2220/3212; F05D 2240/301; F05D 2250/74; Y10S 416/02
See application file for complete search history.

(56) References Cited

U.S. PATENT DOCUMENTS 5,980,209 A * 11/1999 Barry ..... F01D 5/141 416/193 A
6,474,948 B1 * 11/2002 Pirolla ..... F01D 5/141 416/223 A
6,503,059 B1 * 1/2003 Frost ..... F01D 5/141 416/223 A (Continued)

OTHER PUBLICATIONS

PCT Application No. PCT/US2019/045133, International Search Report and Written Opinion, dated Oct. 16, 2019, nine pages.

*Primary Examiner* — Igor Kershteyn
(74) *Attorney, Agent, or Firm* — Lathrop GPM LLP

(57) ABSTRACT

A turbine blade having an airfoil profile substantially in accordance with Cartesian coordinate values of X, Y, and Z set forth in Table 1, where the X and Y values are in inches and the Z values are non-dimensional values from 0 to 1 and convertible to Z distances in inches by multiplying the Z values by the height of the airfoil in inches. The X and Y values are distances which, when connected by smooth continuing arcs, define airfoil profile sections at each distance Z. The profile sections at each distance Z are joined smoothly to one another to form an airfoil shape. The X, Y, and Z distances may be scaled as a function of the same constant number and the X, Y, and Z distances lie within an envelope of approximately +/−0.032 inches in directions normal to the airfoil.

21 Claims, 8 Drawing Sheets

(56) References Cited

U.S. PATENT DOCUMENTS

| | | | | |
|---|---|---|---|---|
| 6,769,878 | B1 * | 8/2004 | Parker | F01D 5/141 416/223 A |
| 7,306,436 | B2 * | 12/2007 | Girgis | F01D 5/141 416/223 A |
| 7,467,924 | B2 | 12/2008 | Charbonneau et al. | |
| 7,559,746 | B2 * | 7/2009 | Tsifourdaris | F01D 5/141 416/191 |
| 7,559,748 | B2 * | 7/2009 | Kidikian | F01D 5/141 416/223 A |
| 2005/0079061 | A1 | 4/2005 | Beddard | |
| 2005/0111978 | A1 * | 5/2005 | Strohl | F01D 5/141 416/97 R |
| 2007/0183896 | A1 | 8/2007 | Jay et al. | |
| 2008/0118358 | A1 | 5/2008 | Tsifourdaris et al. | |
| 2008/0273984 | A1 | 11/2008 | Liang et al. | |
| 2009/0290987 | A1 * | 11/2009 | Parker | F01D 5/141 416/241 R |
| 2011/0116917 | A1 * | 5/2011 | Wang | F01D 5/141 415/208.1 |
| 2015/0247407 | A1 | 9/2015 | Lecuyer et al. | |

* cited by examiner

SECOND STAGE TURBINE BLADE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention disclosure relates generally to a turbine blade for use in a gas turbine engine and more specifically to surface profiles for a second stage turbine blade.

BACKGROUND OF THE INVENTION

A gas turbine engine typically comprises a multi-stage compressor coupled to a multi-stage turbine via an axial shaft. Air enters the gas turbine engine through the compressor where its temperature and pressure are increased as it passes through subsequent stages of the compressor. The compressed air is then directed to one or more combustors where it is mixed with a fuel source to create a combustible mixture. This mixture is ignited in the one or more combustors to create a flow of hot combustion gases. These gases are directed into the turbine causing the turbine to rotate, thereby driving the compressor. The output of the gas turbine engine can be mechanical thrust through exhaust from the turbine or shaft power from the rotation of an axial shaft, where the axial shaft can drive a generator to produce electricity.

The compressor and turbine each comprise a plurality of rotating blades and stationary vanes having an airfoil extending into the flow of compressed air or flow of hot combustion gases. Each blade or vane has a particular set of design criteria which must be met in order to provide the necessary work to the passing flow through the compressor and the turbine. However, due to the severe nature of the operating environments especially prevalent in the turbine, it is beneficial to optimize the performance of the airfoil.

BRIEF SUMMARY OF THE INVENTION

The present invention discloses a turbine blade having an improved airfoil configuration for use in a gas turbine engine.

In an embodiment of the present invention, a turbine blade comprises a blade root, a platform extending from the blade root, an airfoil extending from the platform, and a shroud extending from the airfoil. The airfoil has an airfoil shape and a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape.

In an alternate embodiment of the present invention, a turbine blade is disclosed comprising a blade root, a platform extending from the blade root, an airfoil extending from the platform, and a shroud extending from the airfoil, where the airfoil has an airfoil shape. The airfoil has a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape. The airfoil shape lies in an envelope within an envelope of approximately −0.032 to +0.032 inches in a direction normal to any surface of the airfoil.

In a further embodiment of the present invention, a turbine comprises a turbine wheel positioned along an engine centerline. The turbine wheel has a plurality of turbine blades secured thereto where each turbine blade comprises a blade root, a platform extending radially outward from the blade root, an airfoil extending radially outward from the platform, and a shroud extending from the airfoil. The airfoil has an airfoil shape and a nominal profile substantially in accordance with Cartesian coordinate values of X, Y, and Z set forth in Table 1 where the Z values are non-dimensional values from 0 to 1 convertible to Z distances in inches by multiplying the Z values by a height of the airfoil in inches. The X and Y are distances in inches which, when connected by smooth continuing arcs, define airfoil profile sections at each distance Z. The profile sections at the Z distances are joined smoothly with one another to form a complete airfoil shape.

In yet a further embodiment of the present invention, a turbine comprises a turbine wheel positioned along an engine centerline and a plurality of turbine blades secured thereto, where each turbine blade comprises a blade root, a platform extending radially outward from the blade root, an airfoil extending radially outward from the platform, and a shroud extending from the airfoil. The airfoil has an airfoil shape and a nominal profile substantially in accordance with Cartesian coordinate values of X, Y, and Z set forth in Table 1 where the Z values are non-dimensional values from 0 to 1 convertible to Z distances in inches by multiplying the Z values by a height of the airfoil in inches. The X and Y are distances in inches which, when connected by smooth continuing arcs, define airfoil profile sections at each distance Z. The profile sections at the Z distances are joined smoothly with one another to form a complete airfoil shape, where the airfoil shape lies in an envelope within approximately +0.032 to −0.032 inches in a direction normal to any surface location of the airfoil.

These and other features of the present invention can be best understood from the following description and claims.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
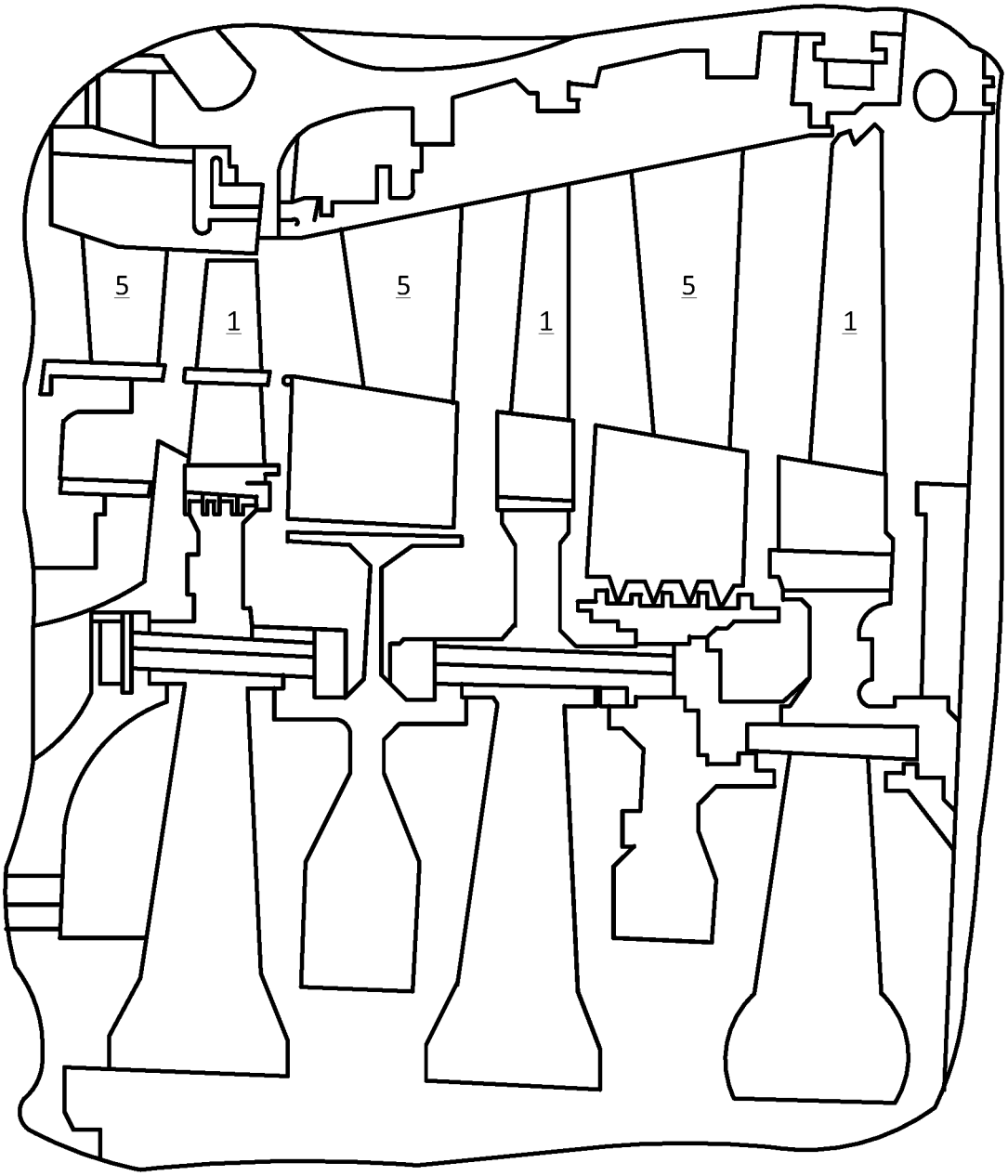
FIG. 1 is an elevation view of a portion of a gas turbine engine.
Figure 2:
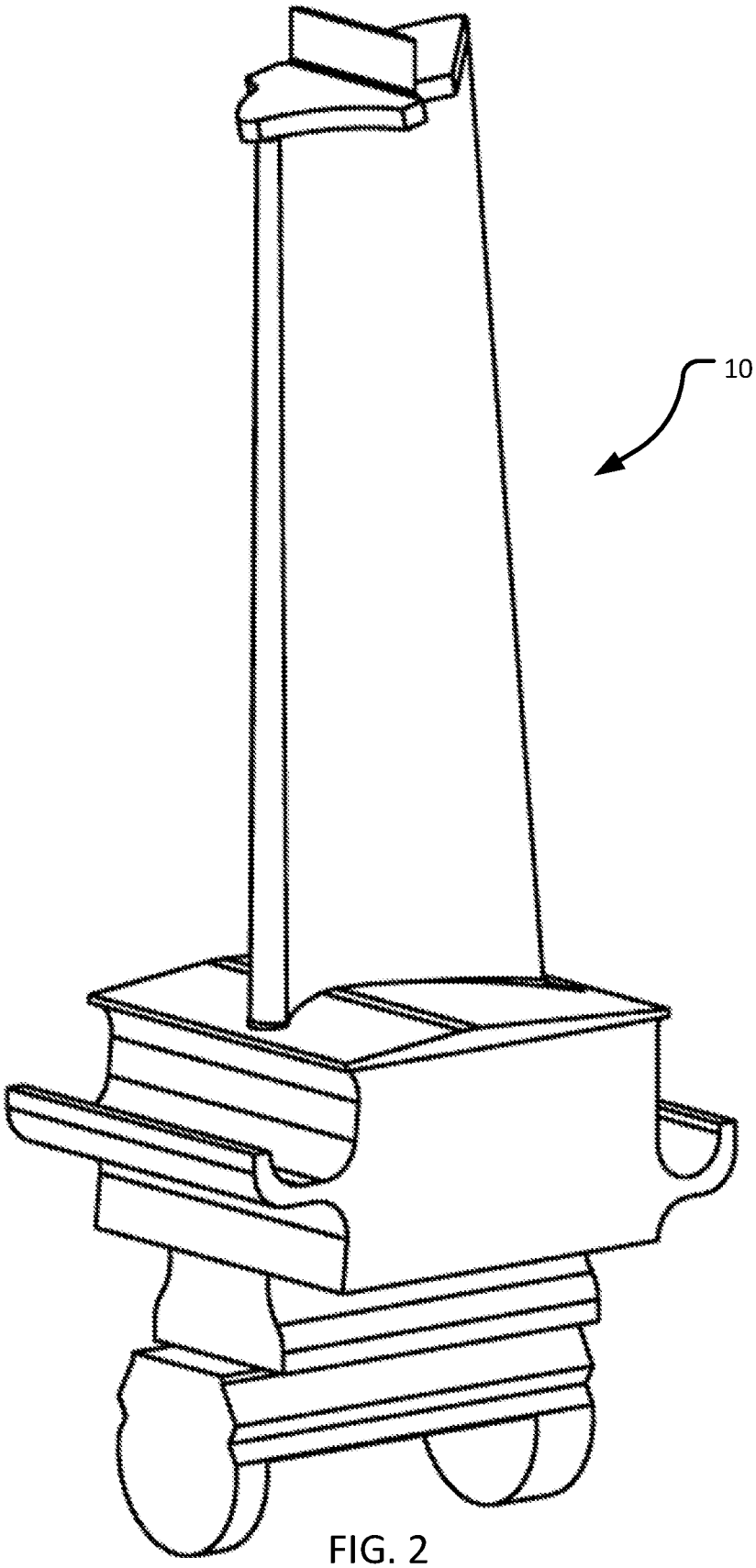
FIG. 2 is a perspective view of a turbine blade casting in accordance with an embodiment of the present invention.

The present invention is intended for use in a gas turbine engine, such as a gas turbine used for power generation, a portion of which is depicted in FIG. 1. The present invention is applicable to multiple gas turbine engines used for power generation, regardless of the manufacturer.

As those skilled in the art will readily appreciate, such a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel which is burned in the combustion section and expanded in turbine. The air compressed in the compressor and the fuel mixture expanded in the turbine can both be referred to as a "hot gas stream flow." The turbine includes rotors that, in response to the fluid expansion, rotate, thereby driving the compressor. The turbine comprises alternating rows of rotary turbine blades, and static airfoils, often referred to as vanes.

Figure 3:
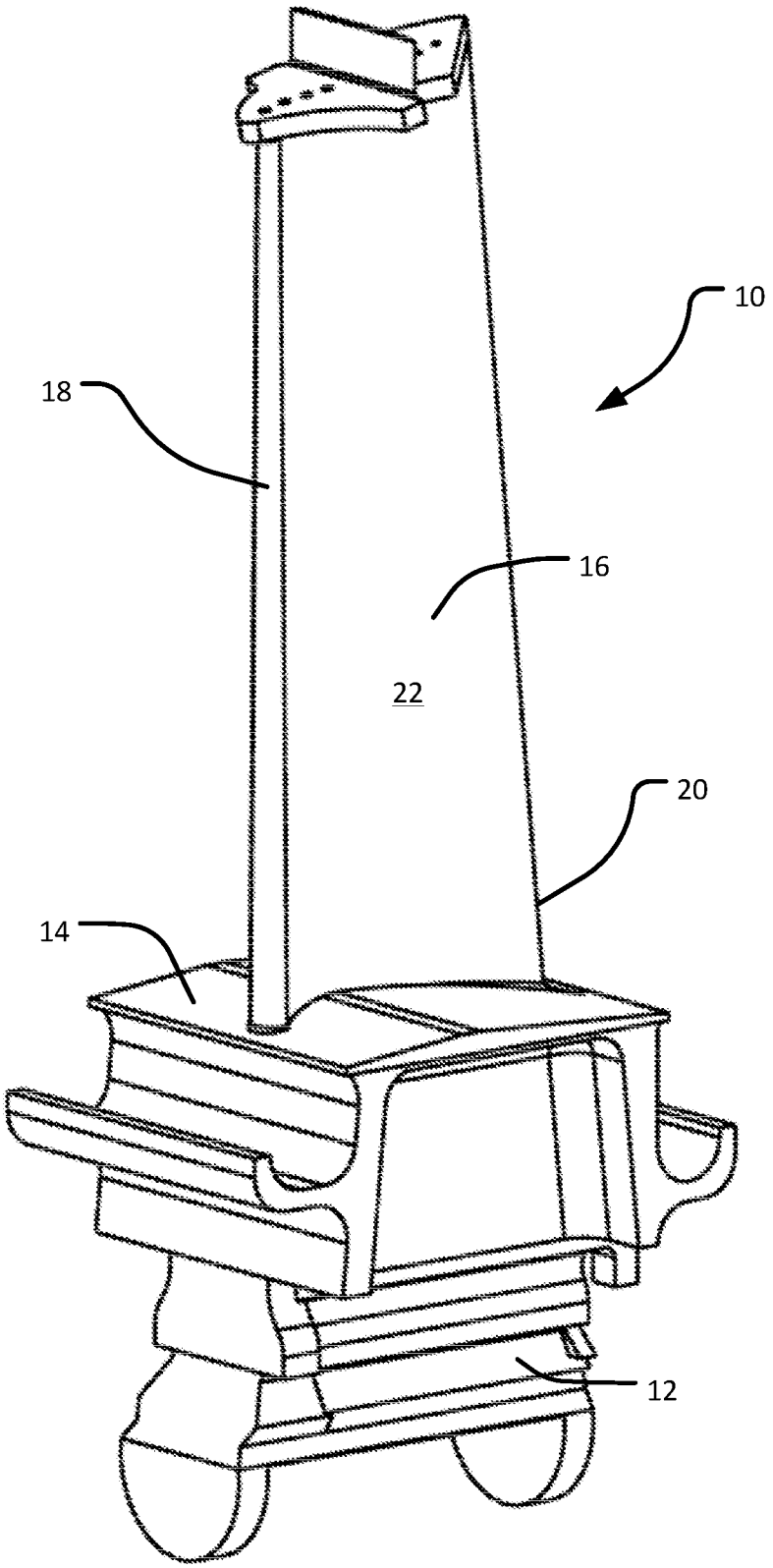
FIG. 3 is a perspective view of a turbine blade including an airfoil in accordance with an embodiment of the present invention.
Figure 4:
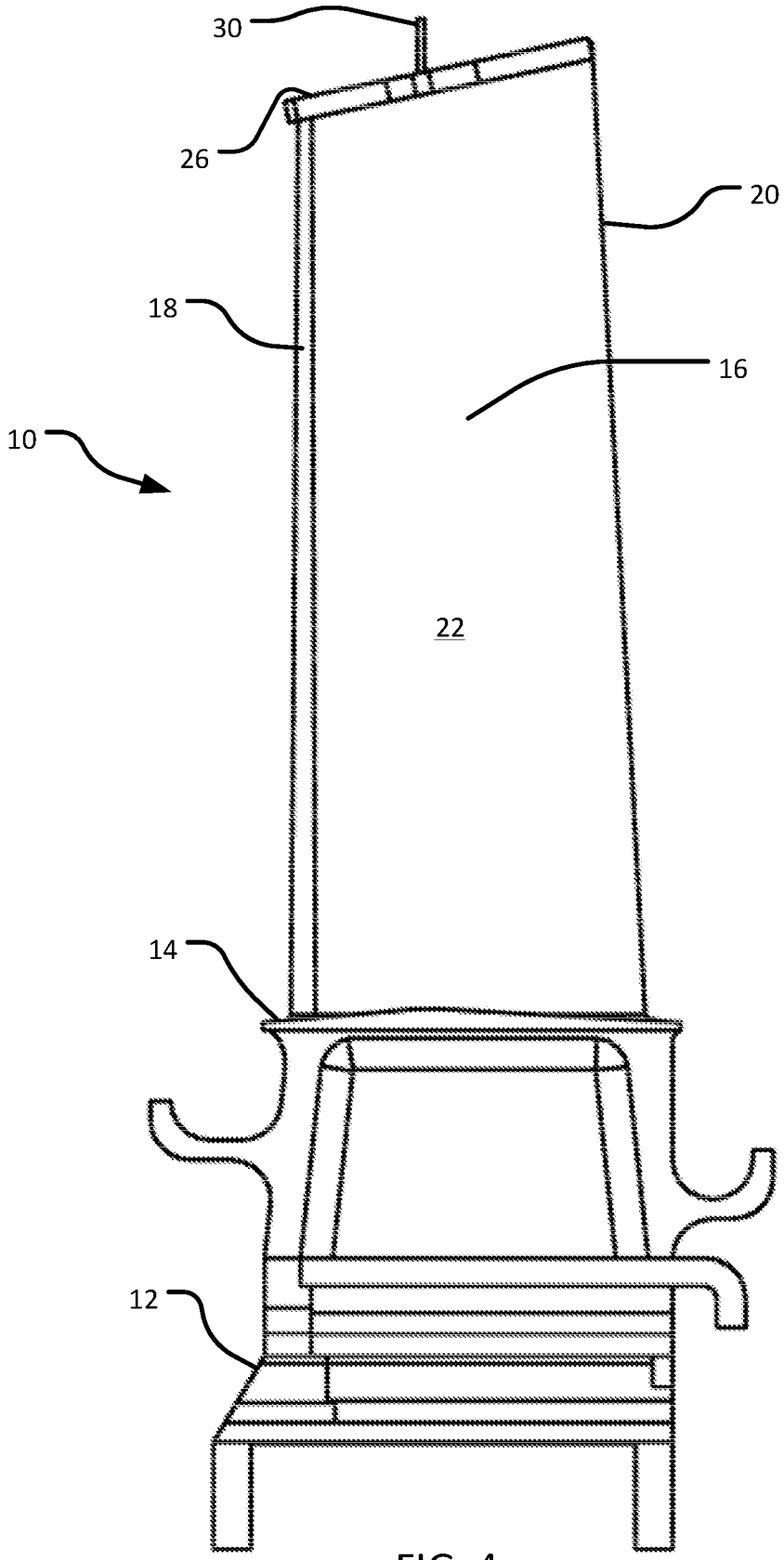
FIG. 4 is a side elevation view of a turbine blade including an airfoil in accordance with an embodiment of the present invention.
Figure 5:
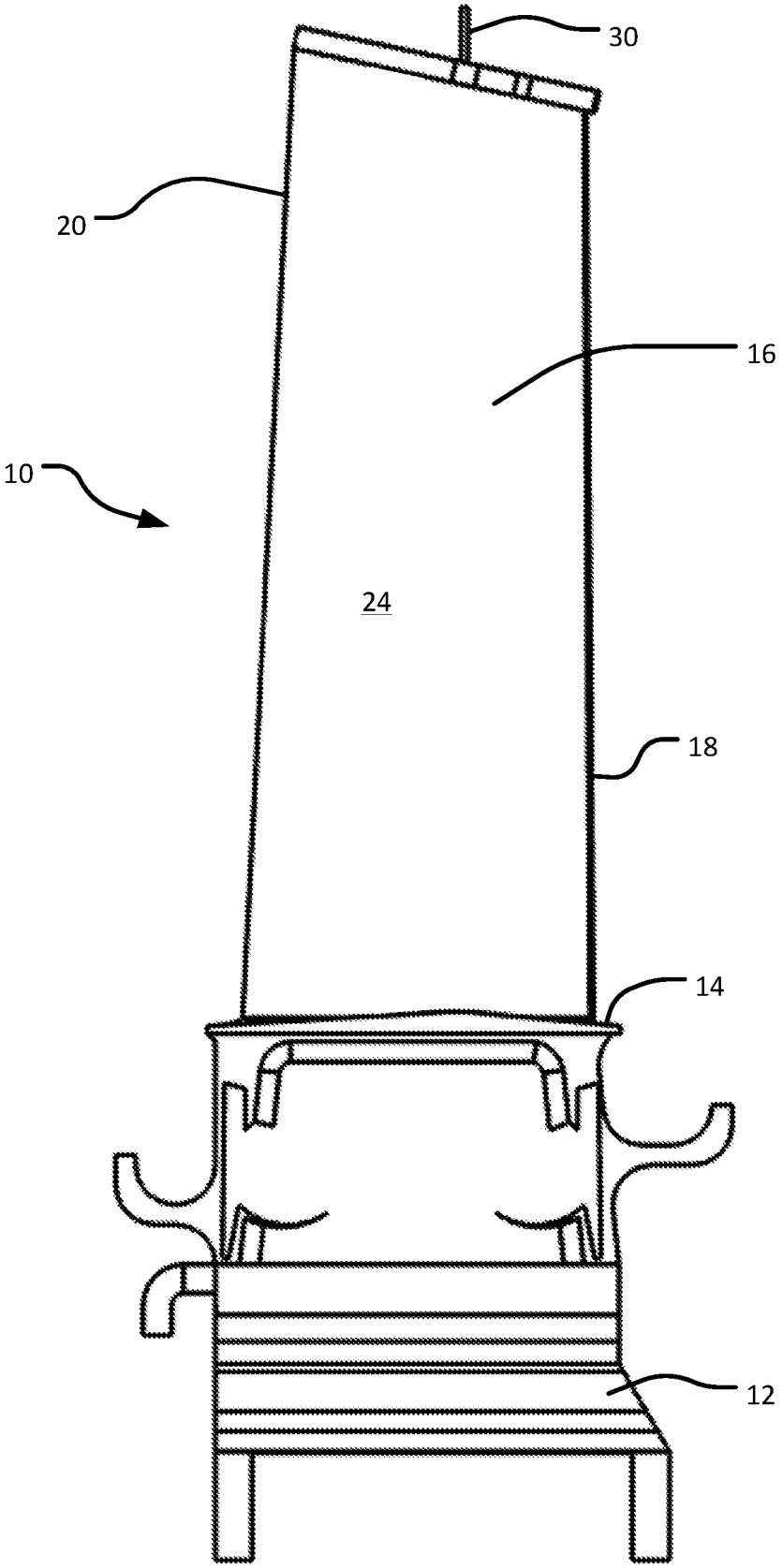
FIG. 5 is an alternate side elevation view of the turbine blade of FIG. 4 including an airfoil in accordance an embodiment of the present invention.
Figure 6:
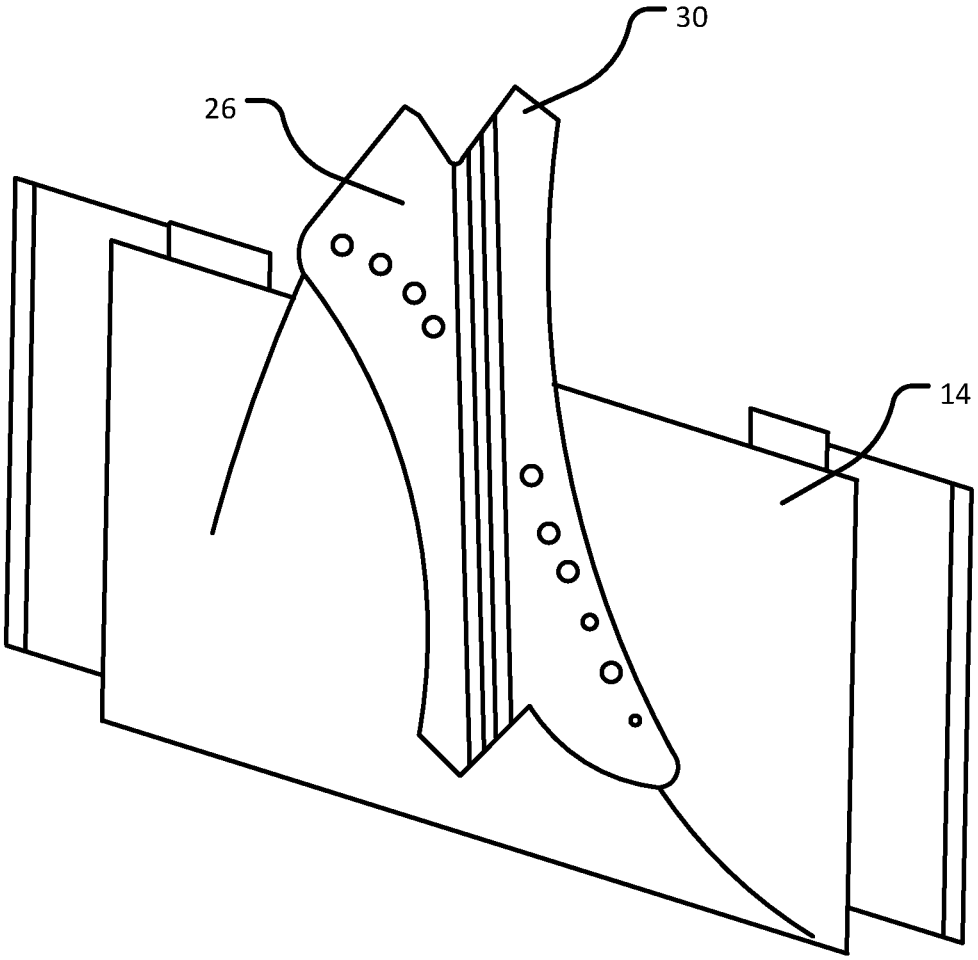
FIG. 6 is a top view of a turbine blade including an airfoil in accordance with an embodiment of the present invention.
Figure 7:
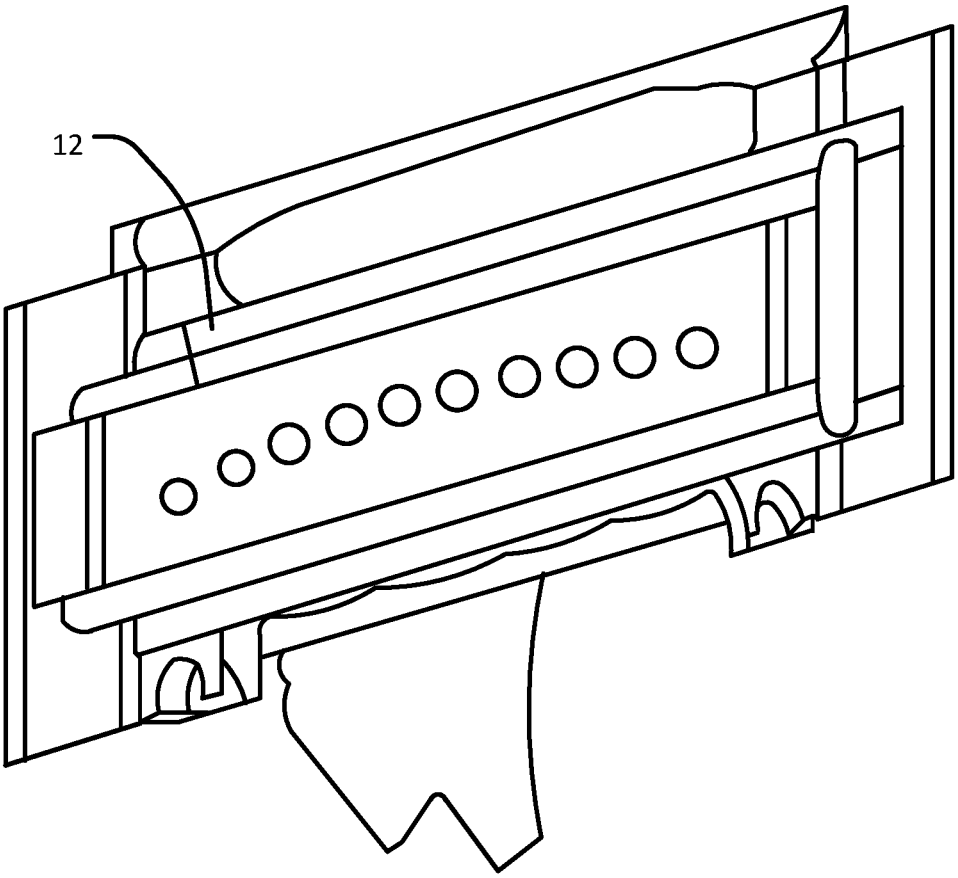
FIG. 7 is the bottom view of the turbine blade of FIG. 6 in accordance with an embodiment of the present invention.

A turbine blade in accordance with embodiments of the present invention is shown in FIGS. 1-8. Referring initially to FIG. 1, a cross section of a portion of a turbine is shown. The turbine includes multiple stages of alternating rows of turbine blades 1 and vanes 5. The present invention provides a turbine blade 10 for a second stage of a gas turbine engine, or the second row of rotating turbine blades. The turbine blade 10 is shown in its cast form in FIG. 2. Referring to FIGS. 3-5, a turbine blade 10 has a blade root 12, a platform 14 extending from the blade root 12, and an airfoil 16 extending from the platform 14. The airfoil 16 has a leading edge 18 and an opposing trailing edge 20. Extending along the airfoil shape between the leading edge 18 and trailing edge 20 is a pressure side surface 22 having a generally concave shape and an opposing suction side surface 24 having a generally convex shape. The airfoil extends to a shroud tip 26 located opposite the platform 14. A top view of the shroud tip 26 is shown in FIG. 6 and an opposing bottom view of the blade root 12 is shown in FIG. 7.

Figure 8:
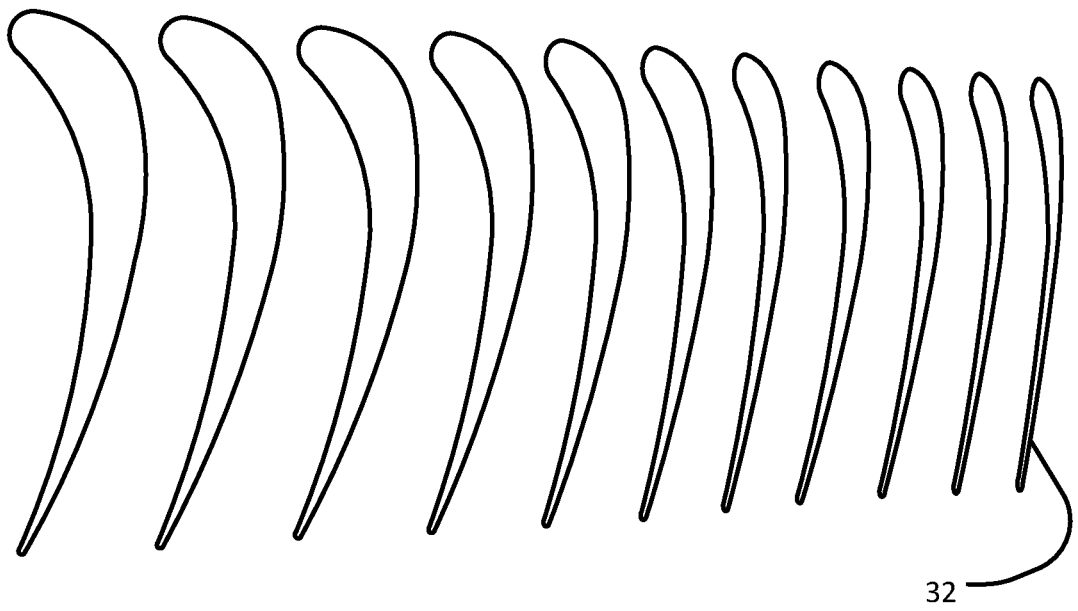
FIG. 8 is a perspective view illustrating the airfoil profile sections outlined in the Cartesian coordinates of Table 1.

The airfoil 16 has a nominal uncoated profile substantially in accordance with Cartesian coordinate values of X, Y, and Z as set forth in Table 1 where the Z values are non-dimensional values from 0 to 1 which are convertible to Z distances in inches by multiplying the Z values by a height of the airfoil in inches. The X and Y values are distances in inches which, when connected by smooth continuing arcs, define airfoil profile sections 32 at each distance Z. The profile sections 32 at the Z distances, as shown in FIG. 8, are joined smoothly with one another to form a complete airfoil shape.

The turbine blade 10 as disclosed herein is preferably part of a second stage turbine of a gas turbine engine and has an airfoil height of approximately 14.147 inches as measured from proximate a midpoint of the platform 14 to a shroud, or tip, 26 of the airfoil 16. In an alternate embodiment of the present invention, the turbine blade 10 further comprises a coating applied to the airfoil 16. A variety of coatings can be applied to the airfoil 16 in order to improve the airfoil capabilities with respect to the temperatures to which it is subjected in the turbine. One such acceptable coating is a metallic MCrAlY and a thermal barrier coating. The MCrAlY is applied approximately 0.008 inches thick and then has up to approximately 0.020 inches of thermal barrier coating applied over the MCrAlY. Such acceptable coatings are applied to all surfaces of the airfoil 16 between the platform 14 and the shroud 26. In an embodiment of the present invention, the mating faces of adjacent shrouds may also have a hardface coating applied thereto. As one skilled in the art will understand, the shrouds of adjacent turbine blades contact each other to provide both a sealing area for the outer region of the turbine stage as well as a way of dampening vibrations of the airfoil portion of the turbine blades. Such coating helps to reduce the amount of frictional wear that occurs between the mating faces of adjacent shrouds. As a result of the coating applied to the surface of airfoil 16, the overall envelope of the airfoil 16 increases to +0.060 to −0.032, depending on the profile of the blade casting and tolerances of the coating applied to the airfoil.

Depending on the operating conditions of the turbine blade 10, the blade may be cooled with a cooling fluid, such as compressed air or steam. A variety of cooling configurations can be utilized to cool the airfoil 16 and shroud 26 of turbine blade 10 and effectively lower the overall operating temperature of the blade. One such acceptable cooling configuration utilizes a plurality of radially extending cooling passages extending from the root 12 to the shroud 26. The passages may also include internal surface features for turbulating the cooling fluid passing through the plurality of passages. The present invention is not limited to the generally radial orientation of cooling passages and could employ alternate cooling configurations. The airfoil 16 is of sufficient size to incorporate alternate internal cooling configurations such as serpentine cooling. As one skilled in the art understands, it is necessary to cool certain stages of turbine blades due to their extremely high operating temperatures. Also, a variety of cooling fluids can be utilized to accomplish this cooling, such as air or steam.

Referring to FIGS. 4-6, the shroud 26 further comprises a one or more knife edges 30 extending radially outward from the shroud 26, or opposite of the airfoil 16. The knife edges 30 extend towards an outer seal of the turbine stage, as shown in FIG. 1. Depending on clearances between the turbine stage and outer seal, it is possible for the knife edges 30 to cut a groove into the outer seal thereby forming an outer air seal for the second stage of the turbine. The number of knife edges 30 on a blade can vary, but are typically one or two, depending on the geometry of the shroud 26.

The values of Table 1 for determining the profile of the airfoil are generated and shown to three decimal places. These values in Table 1 are for a nominal, uncoated airfoil. However, there are typical manufacturing tolerances as well as coatings, which can cause the profile of the airfoil to vary from the values of Table 1. Thus, in an alternate embodiment of the present invention, a turbine blade 10, as disclosed above, is provided where the airfoil shape lies in an envelope within approximately +0.032 to −0.032 inches in a direction normal to any surface location of the airfoil 16. That is, due to a variety of manufacturing issues such as variations that occur in airfoil casting, wall thickness, and machining of turbine blade 10, the exact location of the airfoil shape can vary by up to approximately +/−0.032 inches. However, these variations in the airfoil profile still result in an airfoil fully capable of the required performance of a second stage turbine blade that is within the scope of the present invention.

The present invention can also be used in a variety of turbine applications. That is, the airfoil 16 is designed such that its profile is scalable for use in a variety of gas turbine engines. In order to scale the airfoil 16, the X and Y values are multiplied by a first constant, which can be greater or less than 1.0, and the Z values are multiplied by a second constant. Typically, the X and Y values are multiplied by the same constant while the Z values are multiplied by a second constant, which may be different from the first constant.

In addition to scaling the airfoil 16, the orientation of the airfoil can also change. More specifically, in alternate embodiments of the present invention, the airfoil orientation can rotate with respect to an axis extending radially outward from each airfoil section, or along the Z values. This axis can be the stacking axis of the airfoil 16. As one skilled in the art will understand, rotating the orientation of the airfoil 16 can reconfigure the aerodynamic loading on the blade, resulting in a change in the amount of work produced by the turbine blade 10 as well as the mechanical stresses on the blade.

The present invention has an airfoil 16 that has been designed to operate in a different way and with different results compared to prior art second stage turbine blades. More specifically, the improved aerodynamic profile of the present invention, as shown herein, has a new and unique aerodynamic profile which creates a unique lift coefficient, about 4% higher than prior art configurations, and produces an 11% increase in blade output power. This is achieved through a reduction in the flow capacity (or throat between adjacent blades) by approximately 4%. This reduction in throat area causes an increased pressure ratio across the blade. Though the exit Mach number is increased from 0.84 to 0.88, the new aerodynamic profile of the turbine achieves a reduction in aerodynamic loss of about 0.23%. These improvements are a result of the new aerodynamic profile.

In an alternate embodiment of the present invention, a turbine is disclosed having a turbine wheel positioned along an engine centerline. The turbine wheel has a plurality of turbine blades 10 secured to the turbine wheel, where each turbine blade 10 has a blade root 12, a platform 14 extending from the blade root 12, and an airfoil 16 extending from the platform. The airfoil has a leading edge 18 and an opposing trailing edge 20. Extending along the airfoil shape between the leading edge 18 and trailing edge 20 is a pressure side surface 22 having a generally concave shape and an opposing suction side surface 24 having a generally convex shape. The airfoil 16 extends to a shroud 26 located opposite the platform 14.

For this embodiment of second stage turbine blades, the midpoint of platform 14 lies along a radius from the engine centerline (rotor axis). For purposes of defining the airfoil shape, this location corresponds to a non-dimensional Z value of 0.000. The height of the airfoil 16, as measured from this point is 14.147 inches.

The airfoil has a nominal uncoated profile substantially in accordance with Cartesian coordinate values of X, Y, and Z as set forth in Table 1 where the Z values are non-dimensional values from 0 to 1 which are convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape. The spacing between the profile sections is generally equidistant, along the airfoil span.

In yet another embodiment of the present invention, a turbine, as disclosed above, is provided where a plurality of the turbine blades 10 are secured in the turbine where each blade has an airfoil shape lying in an envelope within +/−0.032 inches in a direction normal to any surface location. That is, due to a variety of manufacturing issues such as variations that occur in airfoil casting and machining of turbine blade 10, the exact location of the airfoil shape can vary by up to approximately +/−0.032 inches. However, such variations in the airfoil profile still provide an airfoil fully within the desired performance of a second stage turbine blade that is within the scope of the present invention. The acceptable profile envelope increases to approximately +0.060 inches to −0.032 inches when accounting for a thermal barrier coating applied to the cast airfoil up to approximately 0.028 inches thick.

As discussed above, the turbine blade 10, although used within a second stage of a turbine section of a gas turbine engine, is not limited to such function. Instead, the airfoil 16 is scalable such that the airfoil 16 can be utilized in other operating environments. That is, the X, Y, and Z values may be scaled as a function of the same constant number to generate a larger or smaller airfoil, having the same airfoil shape, but for use in a different gas turbine engine. A scaled version of the coordinates in Table 1 would be represented by X, Y, and Z coordinate values of Table 1, with the non-dimensional Z coordinate values converted to inches, and then multiplied or divided by a constant number.

The coordinate values given in Table 1 below provide a nominal profile envelope for the airfoil disclosed herein.

TABLE 1

| X | Y | Z |
|---|---|---|
| 2.704 | −2.362 | 0.000 |
| 2.490 | −2.018 | 0.000 |
| 2.265 | −1.693 | 0.000 |
| 2.036 | −1.399 | 0.000 |
| 1.810 | −1.145 | 0.000 |
| 1.594 | −0.932 | 0.000 |
| 1.389 | −0.757 | 0.000 |
| 1.195 | −0.616 | 0.000 |
| 1.011 | −0.502 | 0.000 |
| 0.833 | −0.410 | 0.000 |
| 0.658 | −0.338 | 0.000 |
| 0.486 | −0.284 | 0.000 |
| 0.324 | −0.248 | 0.000 |
| 0.177 | −0.228 | 0.000 |
| 0.040 | −0.219 | 0.000 |
| −0.089 | −0.220 | 0.000 |
| −0.217 | −0.229 | 0.000 |
| −0.344 | −0.246 | 0.000 |
| −0.470 | −0.271 | 0.000 |
| −0.594 | −0.304 | 0.000 |
| −0.716 | −0.345 | 0.000 |
| −0.837 | −0.394 | 0.000 |
| −0.958 | −0.451 | 0.000 |
| −1.079 | −0.517 | 0.000 |
| −1.198 | −0.590 | 0.000 |
| −1.317 | −0.671 | 0.000 |
| −1.437 | −0.761 | 0.000 |
| −1.561 | −0.860 | 0.000 |
| −1.561 | −0.860 | 0.000 |
| −1.579 | −0.874 | 0.000 |
| −1.596 | −0.887 | 0.000 |
| −1.614 | −0.899 | 0.000 |
| −1.632 | −0.910 | 0.000 |
| −1.650 | −0.920 | 0.000 |
| −1.670 | −0.928 | 0.000 |

TABLE 1-continued

| X | Y | Z |
|---|---|---|
| −1.690 | −0.935 | 0.000 |
| −1.709 | −0.940 | 0.000 |
| −1.727 | −0.942 | 0.000 |
| −1.743 | −0.943 | 0.000 |
| −1.759 | −0.941 | 0.000 |
| −1.774 | −0.936 | 0.000 |
| −1.787 | −0.929 | 0.000 |
| −1.800 | −0.918 | 0.000 |
| −1.812 | −0.904 | 0.000 |
| −1.822 | −0.887 | 0.000 |
| −1.830 | −0.867 | 0.000 |
| −1.836 | −0.845 | 0.000 |
| −1.840 | −0.822 | 0.000 |
| −1.842 | −0.796 | 0.000 |
| −1.842 | −0.769 | 0.000 |
| −1.841 | −0.742 | 0.000 |
| −1.838 | −0.715 | 0.000 |
| −1.838 | −0.715 | 0.000 |
| −1.825 | −0.637 | 0.000 |
| −1.807 | −0.560 | 0.000 |
| −1.786 | −0.484 | 0.000 |
| −1.760 | −0.410 | 0.000 |
| −1.731 | −0.337 | 0.000 |
| −1.698 | −0.265 | 0.000 |
| −1.662 | −0.195 | 0.000 |
| −1.625 | −0.127 | 0.000 |
| −1.584 | −0.060 | 0.000 |
| −1.538 | 0.012 | 0.000 |
| −1.483 | 0.090 | 0.000 |
| −1.416 | 0.177 | 0.000 |
| −1.337 | 0.272 | 0.000 |
| −1.243 | 0.373 | 0.000 |
| −1.135 | 0.476 | 0.000 |
| −1.017 | 0.575 | 0.000 |
| −0.890 | 0.665 | 0.000 |
| −0.758 | 0.743 | 0.000 |
| −0.624 | 0.807 | 0.000 |
| −0.491 | 0.856 | 0.000 |
| −0.361 | 0.891 | 0.000 |
| −0.233 | 0.912 | 0.000 |
| −0.106 | 0.922 | 0.000 |
| 0.023 | 0.919 | 0.000 |
| 0.155 | 0.904 | 0.000 |
| 0.288 | 0.875 | 0.000 |
| 0.426 | 0.833 | 0.000 |
| 0.568 | 0.774 | 0.000 |
| 0.717 | 0.697 | 0.000 |
| 0.873 | 0.600 | 0.000 |
| 1.037 | 0.478 | 0.000 |
| 1.211 | 0.326 | 0.000 |
| 1.395 | 0.141 | 0.000 |
| 1.587 | −0.079 | 0.000 |
| 1.778 | −0.328 | 0.000 |
| 1.954 | −0.582 | 0.000 |
| 2.107 | −0.825 | 0.000 |
| 2.238 | −1.047 | 0.000 |
| 2.347 | −1.244 | 0.000 |
| 2.442 | −1.423 | 0.000 |
| 2.528 | −1.593 | 0.000 |
| 2.612 | −1.763 | 0.000 |
| 2.694 | −1.937 | 0.000 |
| 2.774 | −2.113 | 0.000 |
| 2.850 | −2.288 | 0.000 |
| 2.850 | −2.288 | 0.000 |
| 2.858 | −2.307 | 0.000 |
| 2.862 | −2.325 | 0.000 |
| 2.865 | −2.342 | 0.000 |
| 2.865 | −2.358 | 0.000 |
| 2.864 | −2.373 | 0.000 |
| 2.862 | −2.386 | 0.000 |
| 2.858 | −2.398 | 0.000 |
| 2.853 | −2.408 | 0.000 |
| 2.847 | −2.417 | 0.000 |
| 2.839 | −2.424 | 0.000 |
| 2.830 | −2.430 | 0.000 |
| 2.826 | −2.432 | 0.000 |
| 2.821 | −2.433 | 0.000 |
| 2.815 | −2.435 | 0.000 |

TABLE 1-continued

| X | Y | Z |
|---|---|---|
| 2.810 | −2.435 | 0.000 |
| 2.805 | −2.435 | 0.000 |
| 2.799 | −2.435 | 0.000 |
| 2.788 | −2.433 | 0.000 |
| 2.776 | −2.428 | 0.000 |
| 2.764 | −2.422 | 0.000 |
| 2.752 | −2.415 | 0.000 |
| 2.739 | −2.405 | 0.000 |
| 2.727 | −2.393 | 0.000 |
| 2.715 | −2.379 | 0.000 |
| 2.704 | −2.362 | 0.000 |
| 2.590 | −2.265 | 0.100 |
| 2.502 | −2.118 | 0.100 |
| 2.411 | −1.971 | 0.100 |
| 2.317 | −1.825 | 0.100 |
| 2.223 | −1.684 | 0.100 |
| 2.125 | −1.545 | 0.100 |
| 2.018 | −1.398 | 0.100 |
| 1.891 | −1.235 | 0.100 |
| 1.738 | −1.051 | 0.100 |
| 1.561 | −0.858 | 0.100 |
| 1.368 | −0.670 | 0.100 |
| 1.170 | −0.504 | 0.100 |
| 0.984 | −0.369 | 0.100 |
| 0.812 | −0.264 | 0.100 |
| 0.648 | −0.182 | 0.100 |
| 0.489 | −0.118 | 0.100 |
| 0.332 | −0.070 | 0.100 |
| 0.175 | −0.038 | 0.100 |
| 0.021 | −0.020 | 0.100 |
| −0.125 | −0.016 | 0.100 |
| −0.262 | −0.024 | 0.100 |
| −0.392 | −0.042 | 0.100 |
| −0.518 | −0.068 | 0.100 |
| −0.643 | −0.105 | 0.100 |
| −0.767 | −0.151 | 0.100 |
| −0.887 | −0.205 | 0.100 |
| −1.003 | −0.265 | 0.100 |
| −1.116 | −0.333 | 0.100 |
| −1.228 | −0.407 | 0.100 |
| −1.343 | −0.490 | 0.100 |
| −1.461 | −0.583 | 0.100 |
| −1.461 | −0.583 | 0.100 |
| −1.481 | −0.600 | 0.100 |
| −1.501 | −0.615 | 0.100 |
| −1.520 | −0.628 | 0.100 |
| −1.541 | −0.641 | 0.100 |
| −1.562 | −0.653 | 0.100 |
| −1.584 | −0.663 | 0.100 |
| −1.607 | −0.671 | 0.100 |
| −1.627 | −0.677 | 0.100 |
| −1.646 | −0.680 | 0.100 |
| −1.662 | −0.680 | 0.100 |
| −1.677 | −0.677 | 0.100 |
| −1.690 | −0.672 | 0.100 |
| −1.702 | −0.665 | 0.100 |
| −1.707 | −0.661 | 0.100 |
| −1.713 | −0.656 | 0.100 |
| −1.718 | −0.651 | 0.100 |
| −1.722 | −0.645 | 0.100 |
| −1.730 | −0.632 | 0.100 |
| −1.737 | −0.619 | 0.100 |
| −1.742 | −0.605 | 0.100 |
| −1.746 | −0.591 | 0.100 |
| −1.750 | −0.576 | 0.100 |
| −1.753 | −0.559 | 0.100 |
| −1.755 | −0.540 | 0.100 |
| −1.756 | −0.519 | 0.100 |
| −1.756 | −0.496 | 0.100 |
| −1.755 | −0.470 | 0.100 |
| −1.751 | −0.443 | 0.100 |
| −1.746 | −0.414 | 0.100 |
| −1.746 | −0.414 | 0.100 |
| −1.728 | −0.342 | 0.100 |
| −1.706 | −0.271 | 0.100 |
| −1.680 | −0.201 | 0.100 |
| −1.651 | −0.134 | 0.100 |
| −1.618 | −0.068 | 0.100 |

TABLE 1-continued

| X | Y | Z |
|---|---|---|
| −1.582 | −0.003 | 0.100 |
| −1.544 | 0.060 | 0.100 |
| −1.503 | 0.122 | 0.100 |
| −1.460 | 0.184 | 0.100 |
| −1.411 | 0.249 | 0.100 |
| −1.355 | 0.317 | 0.100 |
| −1.291 | 0.391 | 0.100 |
| −1.216 | 0.470 | 0.100 |
| −1.130 | 0.553 | 0.100 |
| −1.035 | 0.634 | 0.100 |
| −0.935 | 0.708 | 0.100 |
| −0.832 | 0.773 | 0.100 |
| −0.726 | 0.831 | 0.100 |
| −0.615 | 0.880 | 0.100 |
| −0.498 | 0.922 | 0.100 |
| −0.375 | 0.954 | 0.100 |
| −0.247 | 0.977 | 0.100 |
| −0.118 | 0.987 | 0.100 |
| 0.008 | 0.984 | 0.100 |
| 0.130 | 0.969 | 0.100 |
| 0.254 | 0.943 | 0.100 |
| 0.382 | 0.902 | 0.100 |
| 0.516 | 0.847 | 0.100 |
| 0.658 | 0.772 | 0.100 |
| 0.809 | 0.676 | 0.100 |
| 0.970 | 0.554 | 0.100 |
| 1.134 | 0.408 | 0.100 |
| 1.295 | 0.244 | 0.100 |
| 1.443 | 0.073 | 0.100 |
| 1.570 | −0.087 | 0.100 |
| 1.678 | −0.234 | 0.100 |
| 1.773 | −0.371 | 0.100 |
| 1.864 | −0.508 | 0.100 |
| 1.951 | −0.648 | 0.100 |
| 2.036 | −0.789 | 0.100 |
| 2.118 | −0.931 | 0.100 |
| 2.199 | −1.077 | 0.100 |
| 2.279 | −1.226 | 0.100 |
| 2.357 | −1.378 | 0.100 |
| 2.434 | −1.534 | 0.100 |
| 2.511 | −1.692 | 0.100 |
| 2.586 | −1.854 | 0.100 |
| 2.662 | −2.020 | 0.100 |
| 2.736 | −2.190 | 0.100 |
| 2.736 | −2.190 | 0.100 |
| 2.743 | −2.209 | 0.100 |
| 2.748 | −2.227 | 0.100 |
| 2.751 | −2.244 | 0.100 |
| 2.752 | −2.260 | 0.100 |
| 2.751 | −2.274 | 0.100 |
| 2.749 | −2.288 | 0.100 |
| 2.746 | −2.300 | 0.100 |
| 2.742 | −2.310 | 0.100 |
| 2.737 | −2.319 | 0.100 |
| 2.730 | −2.327 | 0.100 |
| 2.726 | −2.330 | 0.100 |
| 2.722 | −2.333 | 0.100 |
| 2.718 | −2.336 | 0.100 |
| 2.714 | −2.338 | 0.100 |
| 2.709 | −2.340 | 0.100 |
| 2.704 | −2.341 | 0.100 |
| 2.694 | −2.342 | 0.100 |
| 2.683 | −2.341 | 0.100 |
| 2.672 | −2.338 | 0.100 |
| 2.660 | −2.333 | 0.100 |
| 2.648 | −2.327 | 0.100 |
| 2.636 | −2.319 | 0.100 |
| 2.625 | −2.309 | 0.100 |
| 2.613 | −2.297 | 0.100 |
| 2.601 | −2.283 | 0.100 |
| 2.590 | −2.265 | 0.100 |
| 2.477 | −2.167 | 0.200 |
| 2.391 | −2.022 | 0.200 |
| 2.303 | −1.877 | 0.200 |
| 2.213 | −1.734 | 0.200 |
| 2.122 | −1.593 | 0.200 |
| 2.028 | −1.454 | 0.200 |
| 1.926 | −1.308 | 0.200 |

TABLE 1-continued

| X | Y | Z |
|---|---|---|
| 1.807 | −1.146 | 0.200 |
| 1.665 | −0.963 | 0.200 |
| 1.500 | −0.767 | 0.200 |
| 1.315 | −0.569 | 0.200 |
| 1.123 | −0.387 | 0.200 |
| 0.940 | −0.237 | 0.200 |
| 0.770 | −0.117 | 0.200 |
| 0.611 | −0.024 | 0.200 |
| 0.459 | 0.049 | 0.200 |
| 0.312 | 0.104 | 0.200 |
| 0.168 | 0.144 | 0.200 |
| 0.029 | 0.168 | 0.200 |
| −0.104 | 0.180 | 0.200 |
| −0.229 | 0.179 | 0.200 |
| −0.349 | 0.169 | 0.200 |
| −0.467 | 0.149 | 0.200 |
| −0.585 | 0.120 | 0.200 |
| −0.703 | 0.080 | 0.200 |
| −0.818 | 0.033 | 0.200 |
| −0.928 | −0.022 | 0.200 |
| −1.036 | −0.083 | 0.200 |
| −1.143 | −0.151 | 0.200 |
| −1.252 | −0.227 | 0.200 |
| −1.365 | −0.314 | 0.200 |
| −1.365 | −0.314 | 0.200 |
| −1.387 | −0.331 | 0.200 |
| −1.408 | −0.346 | 0.200 |
| −1.429 | −0.361 | 0.200 |
| −1.450 | −0.374 | 0.200 |
| −1.472 | −0.386 | 0.200 |
| −1.495 | −0.397 | 0.200 |
| −1.518 | −0.406 | 0.200 |
| −1.540 | −0.412 | 0.200 |
| −1.559 | −0.415 | 0.200 |
| −1.576 | −0.416 | 0.200 |
| −1.591 | −0.414 | 0.200 |
| −1.605 | −0.409 | 0.200 |
| −1.617 | −0.403 | 0.200 |
| −1.628 | −0.394 | 0.200 |
| −1.638 | −0.383 | 0.200 |
| −1.647 | −0.370 | 0.200 |
| −1.653 | −0.356 | 0.200 |
| −1.658 | −0.342 | 0.200 |
| −1.662 | −0.327 | 0.200 |
| −1.666 | −0.313 | 0.200 |
| −1.668 | −0.296 | 0.200 |
| −1.670 | −0.278 | 0.200 |
| −1.671 | −0.258 | 0.200 |
| −1.671 | −0.235 | 0.200 |
| −1.669 | −0.210 | 0.200 |
| −1.665 | −0.183 | 0.200 |
| −1.659 | −0.153 | 0.200 |
| −1.650 | −0.122 | 0.200 |
| −1.650 | −0.122 | 0.200 |
| −1.627 | −0.056 | 0.200 |
| −1.600 | 0.010 | 0.200 |
| −1.570 | 0.075 | 0.200 |
| −1.537 | 0.136 | 0.200 |
| −1.501 | 0.196 | 0.200 |
| −1.459 | 0.259 | 0.200 |
| −1.408 | 0.330 | 0.200 |
| −1.344 | 0.410 | 0.200 |
| −1.270 | 0.494 | 0.200 |
| −1.191 | 0.575 | 0.200 |
| −1.109 | 0.651 | 0.200 |
| −1.022 | 0.724 | 0.200 |
| −0.931 | 0.791 | 0.200 |
| −0.834 | 0.852 | 0.200 |
| −0.734 | 0.905 | 0.200 |
| −0.630 | 0.951 | 0.200 |
| −0.521 | 0.989 | 0.200 |
| −0.406 | 1.019 | 0.200 |
| −0.285 | 1.041 | 0.200 |
| −0.157 | 1.052 | 0.200 |
| −0.028 | 1.051 | 0.200 |
| 0.098 | 1.037 | 0.200 |
| 0.222 | 1.010 | 0.200 |
| 0.346 | 0.969 | 0.200 |

TABLE 1-continued

| X | Y | Z |
|---|---|---|
| 0.475 | 0.914 | 0.200 |
| 0.611 | 0.840 | 0.200 |
| 0.758 | 0.744 | 0.200 |
| 0.917 | 0.619 | 0.200 |
| 1.081 | 0.468 | 0.200 |
| 1.241 | 0.297 | 0.200 |
| 1.388 | 0.120 | 0.200 |
| 1.513 | −0.045 | 0.200 |
| 1.617 | −0.193 | 0.200 |
| 1.708 | −0.329 | 0.200 |
| 1.793 | −0.463 | 0.200 |
| 1.875 | −0.599 | 0.200 |
| 1.956 | −0.737 | 0.200 |
| 2.034 | −0.876 | 0.200 |
| 2.110 | −1.017 | 0.200 |
| 2.186 | −1.162 | 0.200 |
| 2.260 | −1.309 | 0.200 |
| 2.333 | −1.458 | 0.200 |
| 2.406 | −1.611 | 0.200 |
| 2.478 | −1.767 | 0.200 |
| 2.550 | −1.927 | 0.200 |
| 2.622 | −2.091 | 0.200 |
| 2.622 | −2.091 | 0.200 |
| 2.630 | −2.111 | 0.200 |
| 2.635 | −2.130 | 0.200 |
| 2.638 | −2.147 | 0.200 |
| 2.639 | −2.163 | 0.200 |
| 2.638 | −2.178 | 0.200 |
| 2.636 | −2.191 | 0.200 |
| 2.633 | −2.203 | 0.200 |
| 2.629 | −2.214 | 0.200 |
| 2.624 | −2.223 | 0.200 |
| 2.617 | −2.231 | 0.200 |
| 2.614 | −2.234 | 0.200 |
| 2.610 | −2.237 | 0.200 |
| 2.605 | −2.240 | 0.200 |
| 2.601 | −2.242 | 0.200 |
| 2.596 | −2.244 | 0.200 |
| 2.591 | −2.245 | 0.200 |
| 2.581 | −2.246 | 0.200 |
| 2.570 | −2.245 | 0.200 |
| 2.559 | −2.242 | 0.200 |
| 2.547 | −2.237 | 0.200 |
| 2.535 | −2.230 | 0.200 |
| 2.523 | −2.222 | 0.200 |
| 2.512 | −2.212 | 0.200 |
| 2.500 | −2.200 | 0.200 |
| 2.488 | −2.185 | 0.200 |
| 2.477 | −2.167 | 0.200 |
| 2.364 | −2.068 | 0.300 |
| 2.281 | −1.925 | 0.300 |
| 2.195 | −1.782 | 0.300 |
| 2.109 | −1.641 | 0.300 |
| 2.021 | −1.502 | 0.300 |
| 1.932 | −1.364 | 0.300 |
| 1.834 | −1.219 | 0.300 |
| 1.722 | −1.057 | 0.300 |
| 1.588 | −0.874 | 0.300 |
| 1.433 | −0.676 | 0.300 |
| 1.260 | −0.472 | 0.300 |
| 1.076 | −0.278 | 0.300 |
| 0.899 | −0.113 | 0.300 |
| 0.733 | 0.021 | 0.300 |
| 0.578 | 0.127 | 0.300 |
| 0.434 | 0.210 | 0.300 |
| 0.299 | 0.271 | 0.300 |
| 0.168 | 0.318 | 0.300 |
| 0.041 | 0.350 | 0.300 |
| −0.080 | 0.368 | 0.300 |
| −0.195 | 0.375 | 0.300 |
| −0.306 | 0.371 | 0.300 |
| −0.416 | 0.359 | 0.300 |
| −0.529 | 0.336 | 0.300 |
| −0.641 | 0.303 | 0.300 |
| −0.751 | 0.262 | 0.300 |
| −0.856 | 0.214 | 0.300 |
| −0.959 | 0.159 | 0.300 |
| −1.061 | 0.097 | 0.300 |

TABLE 1-continued

| X | Y | Z |
|---|---|---|
| −1.166 | 0.028 | 0.300 |
| −1.276 | −0.052 | 0.300 |
| −1.276 | −0.052 | 0.300 |
| −1.299 | −0.069 | 0.300 |
| −1.321 | −0.085 | 0.300 |
| −1.343 | −0.099 | 0.300 |
| −1.366 | −0.112 | 0.300 |
| −1.389 | −0.123 | 0.300 |
| −1.413 | −0.134 | 0.300 |
| −1.437 | −0.142 | 0.300 |
| −1.460 | −0.147 | 0.300 |
| −1.480 | −0.150 | 0.300 |
| −1.498 | −0.150 | 0.300 |
| −1.513 | −0.147 | 0.300 |
| −1.527 | −0.142 | 0.300 |
| −1.540 | −0.134 | 0.300 |
| −1.551 | −0.124 | 0.300 |
| −1.561 | −0.112 | 0.300 |
| −1.569 | −0.098 | 0.300 |
| −1.575 | −0.083 | 0.300 |
| −1.579 | −0.068 | 0.300 |
| −1.582 | −0.052 | 0.300 |
| −1.585 | −0.036 | 0.300 |
| −1.586 | −0.019 | 0.300 |
| −1.587 | 0.000 | 0.300 |
| −1.586 | 0.021 | 0.300 |
| −1.584 | 0.044 | 0.300 |
| −1.580 | 0.070 | 0.300 |
| −1.573 | 0.097 | 0.300 |
| −1.565 | 0.126 | 0.300 |
| −1.553 | 0.156 | 0.300 |
| −1.553 | 0.156 | 0.300 |
| −1.525 | 0.216 | 0.300 |
| −1.496 | 0.274 | 0.300 |
| −1.464 | 0.329 | 0.300 |
| −1.430 | 0.383 | 0.300 |
| −1.357 | 0.483 | 0.300 |
| −1.279 | 0.576 | 0.300 |
| −1.197 | 0.661 | 0.300 |
| −1.115 | 0.738 | 0.300 |
| −1.033 | 0.807 | 0.300 |
| −0.949 | 0.869 | 0.300 |
| −0.861 | 0.926 | 0.300 |
| −0.768 | 0.977 | 0.300 |
| −0.672 | 1.020 | 0.300 |
| −0.573 | 1.056 | 0.300 |
| −0.471 | 1.085 | 0.300 |
| −0.364 | 1.107 | 0.300 |
| −0.252 | 1.121 | 0.300 |
| −0.132 | 1.125 | 0.300 |
| −0.008 | 1.118 | 0.300 |
| 0.116 | 1.097 | 0.300 |
| 0.237 | 1.064 | 0.300 |
| 0.359 | 1.018 | 0.300 |
| 0.485 | 0.956 | 0.300 |
| 0.619 | 0.875 | 0.300 |
| 0.763 | 0.770 | 0.300 |
| 0.921 | 0.634 | 0.300 |
| 1.083 | 0.471 | 0.300 |
| 1.235 | 0.293 | 0.300 |
| 1.372 | 0.116 | 0.300 |
| 1.486 | −0.046 | 0.300 |
| 1.580 | −0.188 | 0.300 |
| 1.662 | −0.318 | 0.300 |
| 1.740 | −0.446 | 0.300 |
| 1.816 | −0.576 | 0.300 |
| 1.890 | −0.709 | 0.300 |
| 1.962 | −0.841 | 0.300 |
| 2.032 | −0.976 | 0.300 |
| 2.102 | −1.114 | 0.300 |
| 2.171 | −1.253 | 0.300 |
| 2.239 | −1.394 | 0.300 |
| 2.306 | −1.538 | 0.300 |
| 2.374 | −1.686 | 0.300 |
| 2.442 | −1.837 | 0.300 |
| 2.509 | −1.991 | 0.300 |
| 2.509 | −1.991 | 0.300 |
| 2.517 | −2.011 | 0.300 |

TABLE 1-continued

| X | Y | Z |
|---|---|---|
| 2.522 | −2.030 | 0.300 |
| 2.525 | −2.048 | 0.300 |
| 2.526 | −2.064 | 0.300 |
| 2.526 | −2.079 | 0.300 |
| 2.524 | −2.092 | 0.300 |
| 2.521 | −2.104 | 0.300 |
| 2.517 | −2.115 | 0.300 |
| 2.511 | −2.124 | 0.300 |
| 2.505 | −2.132 | 0.300 |
| 2.501 | −2.136 | 0.300 |
| 2.497 | −2.139 | 0.300 |
| 2.493 | −2.141 | 0.300 |
| 2.488 | −2.144 | 0.300 |
| 2.483 | −2.145 | 0.300 |
| 2.479 | −2.147 | 0.300 |
| 2.468 | −2.147 | 0.300 |
| 2.457 | −2.146 | 0.300 |
| 2.446 | −2.143 | 0.300 |
| 2.434 | −2.138 | 0.300 |
| 2.422 | −2.131 | 0.300 |
| 2.410 | −2.123 | 0.300 |
| 2.399 | −2.113 | 0.300 |
| 2.387 | −2.100 | 0.300 |
| 2.375 | −2.086 | 0.300 |
| 2.364 | −2.068 | 0.300 |
| 2.251 | −1.966 | 0.400 |
| 2.170 | −1.826 | 0.400 |
| 2.087 | −1.685 | 0.400 |
| 2.003 | −1.545 | 0.400 |
| 1.919 | −1.408 | 0.400 |
| 1.833 | −1.271 | 0.400 |
| 1.740 | −1.125 | 0.400 |
| 1.631 | −0.962 | 0.400 |
| 1.503 | −0.776 | 0.400 |
| 1.355 | −0.574 | 0.400 |
| 1.192 | −0.367 | 0.400 |
| 1.022 | −0.170 | 0.400 |
| 0.860 | 0.000 | 0.400 |
| 0.708 | 0.141 | 0.400 |
| 0.566 | 0.256 | 0.400 |
| 0.432 | 0.349 | 0.400 |
| 0.305 | 0.422 | 0.400 |
| 0.183 | 0.478 | 0.400 |
| 0.066 | 0.519 | 0.400 |
| −0.045 | 0.545 | 0.400 |
| −0.151 | 0.560 | 0.400 |
| −0.255 | 0.564 | 0.400 |
| −0.360 | 0.559 | 0.400 |
| −0.468 | 0.544 | 0.400 |
| −0.576 | 0.518 | 0.400 |
| −0.682 | 0.483 | 0.400 |
| −0.784 | 0.442 | 0.400 |
| −0.883 | 0.393 | 0.400 |
| −0.982 | 0.338 | 0.400 |
| −1.084 | 0.275 | 0.400 |
| −1.192 | 0.201 | 0.400 |
| −1.192 | 0.201 | 0.400 |
| −1.216 | 0.185 | 0.400 |
| −1.240 | 0.170 | 0.400 |
| −1.264 | 0.157 | 0.400 |
| −1.288 | 0.145 | 0.400 |
| −1.313 | 0.134 | 0.400 |
| −1.339 | 0.126 | 0.400 |
| −1.364 | 0.119 | 0.400 |
| −1.387 | 0.116 | 0.400 |
| −1.408 | 0.116 | 0.400 |
| −1.425 | 0.118 | 0.400 |
| −1.441 | 0.123 | 0.400 |
| −1.455 | 0.131 | 0.400 |
| −1.468 | 0.142 | 0.400 |
| −1.479 | 0.155 | 0.400 |
| −1.487 | 0.171 | 0.400 |
| −1.493 | 0.189 | 0.400 |
| −1.497 | 0.211 | 0.400 |
| −1.499 | 0.236 | 0.400 |
| −1.499 | 0.263 | 0.400 |
| −1.497 | 0.290 | 0.400 |
| −1.492 | 0.316 | 0.400 |

TABLE 1-continued

| X | Y | Z |
|---|---|---|
| −1.486 | 0.342 | 0.400 |
| −1.477 | 0.368 | 0.400 |
| −1.466 | 0.395 | 0.400 |
| −1.453 | 0.423 | 0.400 |
| −1.453 | 0.423 | 0.400 |
| −1.421 | 0.479 | 0.400 |
| −1.387 | 0.532 | 0.400 |
| −1.352 | 0.582 | 0.400 |
| −1.316 | 0.629 | 0.400 |
| −1.241 | 0.718 | 0.400 |
| −1.161 | 0.800 | 0.400 |
| −1.076 | 0.876 | 0.400 |
| −0.986 | 0.946 | 0.400 |
| −0.890 | 1.010 | 0.400 |
| −0.792 | 1.065 | 0.400 |
| −0.690 | 1.111 | 0.400 |
| −0.584 | 1.150 | 0.400 |
| −0.472 | 1.180 | 0.400 |
| −0.352 | 1.200 | 0.400 |
| −0.230 | 1.210 | 0.400 |
| −0.112 | 1.207 | 0.400 |
| 0.004 | 1.192 | 0.400 |
| 0.122 | 1.166 | 0.400 |
| 0.241 | 1.126 | 0.400 |
| 0.363 | 1.071 | 0.400 |
| 0.492 | 0.999 | 0.400 |
| 0.628 | 0.907 | 0.400 |
| 0.774 | 0.789 | 0.400 |
| 0.929 | 0.641 | 0.400 |
| 1.083 | 0.470 | 0.400 |
| 1.224 | 0.291 | 0.400 |
| 1.347 | 0.119 | 0.400 |
| 1.450 | −0.037 | 0.400 |
| 1.536 | −0.174 | 0.400 |
| 1.611 | −0.300 | 0.400 |
| 1.682 | −0.423 | 0.400 |
| 1.752 | −0.549 | 0.400 |
| 1.821 | −0.675 | 0.400 |
| 1.887 | −0.802 | 0.400 |
| 1.952 | −0.931 | 0.400 |
| 2.017 | −1.062 | 0.400 |
| 2.081 | −1.195 | 0.400 |
| 2.144 | −1.328 | 0.400 |
| 2.207 | −1.465 | 0.400 |
| 2.270 | −1.604 | 0.400 |
| 2.334 | −1.746 | 0.400 |
| 2.397 | −1.891 | 0.400 |
| 2.397 | −1.891 | 0.400 |
| 2.405 | −1.911 | 0.400 |
| 2.410 | −1.930 | 0.400 |
| 2.413 | −1.947 | 0.400 |
| 2.414 | −1.963 | 0.400 |
| 2.413 | −1.978 | 0.400 |
| 2.411 | −1.992 | 0.400 |
| 2.408 | −2.004 | 0.400 |
| 2.404 | −2.014 | 0.400 |
| 2.399 | −2.023 | 0.400 |
| 2.392 | −2.031 | 0.400 |
| 2.384 | −2.038 | 0.400 |
| 2.375 | −2.043 | 0.400 |
| 2.365 | −2.046 | 0.400 |
| 2.355 | −2.047 | 0.400 |
| 2.344 | −2.045 | 0.400 |
| 2.333 | −2.042 | 0.400 |
| 2.321 | −2.037 | 0.400 |
| 2.309 | −2.030 | 0.400 |
| 2.298 | −2.021 | 0.400 |
| 2.286 | −2.011 | 0.400 |
| 2.274 | −1.999 | 0.400 |
| 2.262 | −1.984 | 0.400 |
| 2.251 | −1.966 | 0.400 |
| 2.139 | −1.865 | 0.500 |
| 2.061 | −1.730 | 0.500 |
| 1.983 | −1.595 | 0.500 |
| 1.904 | −1.460 | 0.500 |
| 1.824 | −1.327 | 0.500 |
| 1.743 | −1.194 | 0.500 |
| 1.656 | −1.053 | 0.500 |

TABLE 1-continued

| X | Y | Z |
|---|---|---|
| 1.556 | −0.896 | 0.500 |
| 1.438 | −0.716 | 0.500 |
| 1.303 | −0.519 | 0.500 |
| 1.152 | −0.312 | 0.500 |
| 0.993 | −0.111 | 0.500 |
| 0.838 | 0.070 | 0.500 |
| 0.693 | 0.224 | 0.500 |
| 0.555 | 0.354 | 0.500 |
| 0.425 | 0.462 | 0.500 |
| 0.303 | 0.548 | 0.500 |
| 0.186 | 0.615 | 0.500 |
| 0.076 | 0.665 | 0.500 |
| −0.028 | 0.700 | 0.500 |
| −0.127 | 0.723 | 0.500 |
| −0.225 | 0.736 | 0.500 |
| −0.322 | 0.739 | 0.500 |
| −0.422 | 0.732 | 0.500 |
| −0.522 | 0.716 | 0.500 |
| −0.620 | 0.691 | 0.500 |
| −0.715 | 0.658 | 0.500 |
| −0.810 | 0.618 | 0.500 |
| −0.905 | 0.571 | 0.500 |
| −1.004 | 0.516 | 0.500 |
| −1.107 | 0.451 | 0.500 |
| −1.107 | 0.451 | 0.500 |
| −1.133 | 0.436 | 0.500 |
| −1.158 | 0.422 | 0.500 |
| −1.182 | 0.410 | 0.500 |
| −1.206 | 0.400 | 0.500 |
| −1.229 | 0.392 | 0.500 |
| −1.253 | 0.385 | 0.500 |
| −1.275 | 0.380 | 0.500 |
| −1.296 | 0.378 | 0.500 |
| −1.315 | 0.378 | 0.500 |
| −1.331 | 0.380 | 0.500 |
| −1.345 | 0.383 | 0.500 |
| −1.358 | 0.389 | 0.500 |
| −1.370 | 0.396 | 0.500 |
| −1.381 | 0.406 | 0.500 |
| −1.389 | 0.417 | 0.500 |
| −1.396 | 0.429 | 0.500 |
| −1.401 | 0.443 | 0.500 |
| −1.405 | 0.457 | 0.500 |
| −1.408 | 0.474 | 0.500 |
| −1.409 | 0.491 | 0.500 |
| −1.409 | 0.509 | 0.500 |
| −1.407 | 0.529 | 0.500 |
| −1.404 | 0.550 | 0.500 |
| −1.398 | 0.573 | 0.500 |
| −1.390 | 0.600 | 0.500 |
| −1.378 | 0.630 | 0.500 |
| −1.364 | 0.660 | 0.500 |
| −1.346 | 0.688 | 0.500 |
| −1.346 | 0.688 | 0.500 |
| −1.277 | 0.783 | 0.500 |
| −1.204 | 0.868 | 0.500 |
| −1.128 | 0.943 | 0.500 |
| −1.050 | 1.010 | 0.500 |
| −0.969 | 1.071 | 0.500 |
| −0.885 | 1.125 | 0.500 |
| −0.799 | 1.171 | 0.500 |
| −0.712 | 1.210 | 0.500 |
| −0.622 | 1.243 | 0.500 |
| −0.529 | 1.269 | 0.500 |
| −0.435 | 1.289 | 0.500 |
| −0.341 | 1.301 | 0.500 |
| −0.249 | 1.305 | 0.500 |
| −0.154 | 1.301 | 0.500 |
| −0.055 | 1.288 | 0.500 |
| 0.051 | 1.264 | 0.500 |
| 0.164 | 1.226 | 0.500 |
| 0.283 | 1.173 | 0.500 |
| 0.407 | 1.103 | 0.500 |
| 0.539 | 1.013 | 0.500 |
| 0.678 | 0.899 | 0.500 |
| 0.828 | 0.757 | 0.500 |
| 0.986 | 0.581 | 0.500 |
| 1.143 | 0.379 | 0.500 |

TABLE 1-continued

| X | Y | Z |
|---|---|---|
| 1.288 | 0.167 | 0.500 |
| 1.413 | −0.033 | 0.500 |
| 1.518 | −0.212 | 0.500 |
| 1.606 | −0.371 | 0.500 |
| 1.683 | −0.514 | 0.500 |
| 1.751 | −0.645 | 0.500 |
| 1.814 | −0.769 | 0.500 |
| 1.875 | −0.893 | 0.500 |
| 1.935 | −1.018 | 0.500 |
| 1.994 | −1.143 | 0.500 |
| 2.052 | −1.269 | 0.500 |
| 2.110 | −1.396 | 0.500 |
| 2.168 | −1.526 | 0.500 |
| 2.227 | −1.657 | 0.500 |
| 2.285 | −1.791 | 0.500 |
| 2.285 | −1.791 | 0.500 |
| 2.293 | −1.811 | 0.500 |
| 2.298 | −1.830 | 0.500 |
| 2.301 | −1.847 | 0.500 |
| 2.302 | −1.863 | 0.500 |
| 2.301 | −1.878 | 0.500 |
| 2.299 | −1.891 | 0.500 |
| 2.296 | −1.903 | 0.500 |
| 2.292 | −1.914 | 0.500 |
| 2.286 | −1.923 | 0.500 |
| 2.279 | −1.931 | 0.500 |
| 2.276 | −1.934 | 0.500 |
| 2.272 | −1.937 | 0.500 |
| 2.267 | −1.940 | 0.500 |
| 2.263 | −1.942 | 0.500 |
| 2.253 | −1.945 | 0.500 |
| 2.242 | −1.946 | 0.500 |
| 2.231 | −1.944 | 0.500 |
| 2.220 | −1.941 | 0.500 |
| 2.209 | −1.935 | 0.500 |
| 2.197 | −1.929 | 0.500 |
| 2.185 | −1.920 | 0.500 |
| 2.173 | −1.910 | 0.500 |
| 2.162 | −1.898 | 0.500 |
| 2.150 | −1.883 | 0.500 |
| 2.139 | −1.865 | 0.500 |
| 2.026 | −1.766 | 0.600 |
| 1.953 | −1.637 | 0.600 |
| 1.879 | −1.508 | 0.600 |
| 1.804 | −1.379 | 0.600 |
| 1.730 | −1.253 | 0.600 |
| 1.654 | −1.126 | 0.600 |
| 1.572 | −0.990 | 0.600 |
| 1.476 | −0.837 | 0.600 |
| 1.364 | −0.660 | 0.600 |
| 1.237 | −0.468 | 0.600 |
| 1.102 | −0.272 | 0.600 |
| 0.964 | −0.085 | 0.600 |
| 0.835 | 0.080 | 0.600 |
| 0.716 | 0.222 | 0.600 |
| 0.605 | 0.344 | 0.600 |
| 0.500 | 0.452 | 0.600 |
| 0.401 | 0.544 | 0.600 |
| 0.309 | 0.621 | 0.600 |
| 0.224 | 0.684 | 0.600 |
| 0.144 | 0.736 | 0.600 |
| 0.066 | 0.780 | 0.600 |
| −0.016 | 0.818 | 0.600 |
| −0.101 | 0.849 | 0.600 |
| −0.190 | 0.874 | 0.600 |
| −0.279 | 0.889 | 0.600 |
| −0.367 | 0.896 | 0.600 |
| −0.455 | 0.894 | 0.600 |
| −0.545 | 0.884 | 0.600 |
| −0.636 | 0.864 | 0.600 |
| −0.728 | 0.836 | 0.600 |
| −0.822 | 0.799 | 0.600 |
| −0.917 | 0.754 | 0.600 |
| −1.015 | 0.701 | 0.600 |
| −1.015 | 0.701 | 0.600 |
| −1.042 | 0.687 | 0.600 |
| −1.068 | 0.674 | 0.600 |
| −1.093 | 0.664 | 0.600 |

TABLE 1-continued

| X | Y | Z |
|---|---|---|
| −1.117 | 0.655 | 0.600 |
| −1.142 | 0.648 | 0.600 |
| −1.166 | 0.642 | 0.600 |
| −1.190 | 0.638 | 0.600 |
| −1.212 | 0.637 | 0.600 |
| −1.231 | 0.638 | 0.600 |
| −1.248 | 0.642 | 0.600 |
| −1.262 | 0.647 | 0.600 |
| −1.275 | 0.654 | 0.600 |
| −1.287 | 0.663 | 0.600 |
| −1.296 | 0.674 | 0.600 |
| −1.304 | 0.687 | 0.600 |
| −1.310 | 0.701 | 0.600 |
| −1.314 | 0.715 | 0.600 |
| −1.317 | 0.731 | 0.600 |
| −1.318 | 0.748 | 0.600 |
| −1.317 | 0.766 | 0.600 |
| −1.315 | 0.785 | 0.600 |
| −1.312 | 0.805 | 0.600 |
| −1.306 | 0.826 | 0.600 |
| −1.298 | 0.850 | 0.600 |
| −1.286 | 0.877 | 0.600 |
| −1.271 | 0.906 | 0.600 |
| −1.252 | 0.935 | 0.600 |
| −1.231 | 0.962 | 0.600 |
| −1.231 | 0.962 | 0.600 |
| −1.158 | 1.042 | 0.600 |
| −1.081 | 1.111 | 0.600 |
| −1.003 | 1.171 | 0.600 |
| −0.922 | 1.224 | 0.600 |
| −0.838 | 1.270 | 0.600 |
| −0.751 | 1.311 | 0.600 |
| −0.660 | 1.344 | 0.600 |
| −0.568 | 1.369 | 0.600 |
| −0.476 | 1.388 | 0.600 |
| −0.380 | 1.399 | 0.600 |
| −0.281 | 1.401 | 0.600 |
| −0.176 | 1.394 | 0.600 |
| −0.067 | 1.376 | 0.600 |
| 0.042 | 1.346 | 0.600 |
| 0.152 | 1.303 | 0.600 |
| 0.265 | 1.246 | 0.600 |
| 0.385 | 1.170 | 0.600 |
| 0.513 | 1.073 | 0.600 |
| 0.650 | 0.951 | 0.600 |
| 0.794 | 0.801 | 0.600 |
| 0.947 | 0.617 | 0.600 |
| 1.103 | 0.401 | 0.600 |
| 1.256 | 0.163 | 0.600 |
| 1.391 | −0.069 | 0.600 |
| 1.507 | −0.281 | 0.600 |
| 1.606 | −0.472 | 0.600 |
| 1.693 | −0.645 | 0.600 |
| 1.768 | −0.800 | 0.600 |
| 1.834 | −0.940 | 0.600 |
| 1.895 | −1.070 | 0.600 |
| 1.951 | −1.194 | 0.600 |
| 2.007 | −1.318 | 0.600 |
| 2.063 | −1.443 | 0.600 |
| 2.118 | −1.568 | 0.600 |
| 2.173 | −1.693 | 0.600 |
| 2.173 | −1.693 | 0.600 |
| 2.180 | −1.713 | 0.600 |
| 2.185 | −1.732 | 0.600 |
| 2.188 | −1.749 | 0.600 |
| 2.189 | −1.765 | 0.600 |
| 2.189 | −1.780 | 0.600 |
| 2.187 | −1.794 | 0.600 |
| 2.183 | −1.806 | 0.600 |
| 2.179 | −1.816 | 0.600 |
| 2.174 | −1.825 | 0.600 |
| 2.171 | −1.829 | 0.600 |
| 2.167 | −1.833 | 0.600 |
| 2.163 | −1.836 | 0.600 |
| 2.159 | −1.839 | 0.600 |
| 2.155 | −1.842 | 0.600 |
| 2.150 | −1.844 | 0.600 |
| 2.145 | −1.845 | 0.600 |

TABLE 1-continued

| X | Y | Z |
|---|---|---|
| 2.140 | −1.846 | 0.600 |
| 2.130 | −1.847 | 0.600 |
| 2.119 | −1.845 | 0.600 |
| 2.108 | −1.842 | 0.600 |
| 2.096 | −1.837 | 0.600 |
| 2.084 | −1.830 | 0.600 |
| 2.073 | −1.822 | 0.600 |
| 2.061 | −1.811 | 0.600 |
| 2.049 | −1.799 | 0.600 |
| 2.037 | −1.784 | 0.600 |
| 2.026 | −1.766 | 0.600 |
| 1.913 | −1.669 | 0.700 |
| 1.739 | −1.362 | 0.700 |
| 1.580 | −1.089 | 0.700 |
| 1.434 | −0.846 | 0.700 |
| 1.300 | −0.629 | 0.700 |
| 1.176 | −0.435 | 0.700 |
| 1.061 | −0.262 | 0.700 |
| 0.954 | −0.107 | 0.700 |
| 0.854 | 0.032 | 0.700 |
| 0.760 | 0.157 | 0.700 |
| 0.672 | 0.268 | 0.700 |
| 0.591 | 0.366 | 0.700 |
| 0.516 | 0.452 | 0.700 |
| 0.446 | 0.529 | 0.700 |
| 0.378 | 0.599 | 0.700 |
| 0.310 | 0.666 | 0.700 |
| 0.240 | 0.730 | 0.700 |
| 0.169 | 0.789 | 0.700 |
| 0.098 | 0.843 | 0.700 |
| 0.023 | 0.893 | 0.700 |
| −0.055 | 0.937 | 0.700 |
| −0.137 | 0.977 | 0.700 |
| −0.222 | 1.009 | 0.700 |
| −0.306 | 1.032 | 0.700 |
| −0.389 | 1.047 | 0.700 |
| −0.473 | 1.053 | 0.700 |
| −0.559 | 1.051 | 0.700 |
| −0.648 | 1.039 | 0.700 |
| −0.740 | 1.016 | 0.700 |
| −0.832 | 0.985 | 0.700 |
| −0.923 | 0.947 | 0.700 |
| −0.923 | 0.947 | 0.700 |
| −0.953 | 0.934 | 0.700 |
| −0.981 | 0.924 | 0.700 |
| −1.007 | 0.915 | 0.700 |
| −1.033 | 0.909 | 0.700 |
| −1.056 | 0.904 | 0.700 |
| −1.078 | 0.901 | 0.700 |
| −1.097 | 0.899 | 0.700 |
| −1.116 | 0.899 | 0.700 |
| −1.133 | 0.900 | 0.700 |
| −1.151 | 0.903 | 0.700 |
| −1.168 | 0.908 | 0.700 |
| −1.184 | 0.916 | 0.700 |
| −1.198 | 0.926 | 0.700 |
| −1.210 | 0.939 | 0.700 |
| −1.219 | 0.954 | 0.700 |
| −1.226 | 0.972 | 0.700 |
| −1.230 | 0.993 | 0.700 |
| −1.231 | 1.016 | 0.700 |
| −1.228 | 1.042 | 0.700 |
| −1.222 | 1.068 | 0.700 |
| −1.212 | 1.096 | 0.700 |
| −1.198 | 1.125 | 0.700 |
| −1.181 | 1.154 | 0.700 |
| −1.159 | 1.182 | 0.700 |
| −1.135 | 1.210 | 0.700 |
| −1.108 | 1.235 | 0.700 |
| −1.108 | 1.235 | 0.700 |
| −1.033 | 1.293 | 0.700 |
| −0.955 | 1.343 | 0.700 |
| −0.875 | 1.386 | 0.700 |
| −0.796 | 1.421 | 0.700 |
| −0.716 | 1.450 | 0.700 |
| −0.637 | 1.473 | 0.700 |
| −0.560 | 1.489 | 0.700 |
| −0.483 | 1.500 | 0.700 |

TABLE 1-continued

| X | Y | Z |
|---|---|---|
| −0.406 | 1.505 | 0.700 |
| −0.328 | 1.503 | 0.700 |
| −0.250 | 1.495 | 0.700 |
| −0.174 | 1.482 | 0.700 |
| −0.099 | 1.464 | 0.700 |
| −0.021 | 1.440 | 0.700 |
| 0.064 | 1.407 | 0.700 |
| 0.157 | 1.362 | 0.700 |
| 0.260 | 1.302 | 0.700 |
| 0.370 | 1.224 | 0.700 |
| 0.487 | 1.126 | 0.700 |
| 0.610 | 1.005 | 0.700 |
| 0.739 | 0.860 | 0.700 |
| 0.874 | 0.687 | 0.700 |
| 1.015 | 0.484 | 0.700 |
| 1.162 | 0.248 | 0.700 |
| 1.316 | −0.025 | 0.700 |
| 1.481 | −0.341 | 0.700 |
| 1.657 | −0.704 | 0.700 |
| 1.849 | −1.120 | 0.700 |
| 2.060 | −1.597 | 0.700 |
| 2.060 | −1.597 | 0.700 |
| 2.068 | −1.618 | 0.700 |
| 2.073 | −1.637 | 0.700 |
| 2.075 | −1.654 | 0.700 |
| 2.076 | −1.670 | 0.700 |
| 2.076 | −1.685 | 0.700 |
| 2.074 | −1.699 | 0.700 |
| 2.071 | −1.710 | 0.700 |
| 2.067 | −1.721 | 0.700 |
| 2.064 | −1.725 | 0.700 |
| 2.061 | −1.730 | 0.700 |
| 2.058 | −1.734 | 0.700 |
| 2.055 | −1.737 | 0.700 |
| 2.051 | −1.741 | 0.700 |
| 2.047 | −1.744 | 0.700 |
| 2.042 | −1.746 | 0.700 |
| 2.037 | −1.748 | 0.700 |
| 2.032 | −1.749 | 0.700 |
| 2.027 | −1.750 | 0.700 |
| 2.022 | −1.751 | 0.700 |
| 2.017 | −1.751 | 0.700 |
| 2.007 | −1.749 | 0.700 |
| 1.996 | −1.746 | 0.700 |
| 1.984 | −1.741 | 0.700 |
| 1.972 | −1.734 | 0.700 |
| 1.960 | −1.726 | 0.700 |
| 1.948 | −1.716 | 0.700 |
| 1.937 | −1.703 | 0.700 |
| 1.925 | −1.688 | 0.700 |
| 1.913 | −1.669 | 0.700 |
| 1.801 | −1.576 | 0.800 |
| 1.637 | −1.284 | 0.800 |
| 1.487 | −1.025 | 0.800 |
| 1.350 | −0.793 | 0.800 |
| 1.223 | −0.584 | 0.800 |
| 1.106 | −0.395 | 0.800 |
| 0.998 | −0.225 | 0.800 |
| 0.897 | −0.071 | 0.800 |
| 0.802 | 0.067 | 0.800 |
| 0.714 | 0.192 | 0.800 |
| 0.632 | 0.304 | 0.800 |
| 0.556 | 0.403 | 0.800 |
| 0.486 | 0.491 | 0.800 |
| 0.420 | 0.572 | 0.800 |
| 0.356 | 0.646 | 0.800 |
| 0.293 | 0.718 | 0.800 |
| 0.228 | 0.787 | 0.800 |
| 0.163 | 0.852 | 0.800 |
| 0.098 | 0.913 | 0.800 |
| 0.030 | 0.970 | 0.800 |
| −0.041 | 1.024 | 0.800 |
| −0.114 | 1.073 | 0.800 |
| −0.189 | 1.116 | 0.800 |
| −0.266 | 1.153 | 0.800 |
| −0.345 | 1.183 | 0.800 |
| −0.427 | 1.205 | 0.800 |
| −0.510 | 1.218 | 0.800 |

TABLE 1-continued

| X | Y | Z |
|---|---|---|
| −0.593 | 1.222 | 0.800 |
| −0.676 | 1.216 | 0.800 |
| −0.758 | 1.202 | 0.800 |
| −0.841 | 1.180 | 0.800 |
| −0.841 | 1.180 | 0.800 |
| −0.872 | 1.171 | 0.800 |
| −0.902 | 1.165 | 0.800 |
| −0.931 | 1.161 | 0.800 |
| −0.959 | 1.159 | 0.800 |
| −0.987 | 1.158 | 0.800 |
| −1.016 | 1.159 | 0.800 |
| −1.044 | 1.163 | 0.800 |
| −1.069 | 1.169 | 0.800 |
| −1.090 | 1.177 | 0.800 |
| −1.107 | 1.187 | 0.800 |
| −1.121 | 1.199 | 0.800 |
| −1.132 | 1.213 | 0.800 |
| −1.140 | 1.229 | 0.800 |
| −1.146 | 1.247 | 0.800 |
| −1.148 | 1.267 | 0.800 |
| −1.147 | 1.287 | 0.800 |
| −1.142 | 1.309 | 0.800 |
| −1.134 | 1.332 | 0.800 |
| −1.122 | 1.356 | 0.800 |
| −1.107 | 1.379 | 0.800 |
| −1.091 | 1.400 | 0.800 |
| −1.072 | 1.420 | 0.800 |
| −1.053 | 1.439 | 0.800 |
| −1.031 | 1.457 | 0.800 |
| −1.007 | 1.474 | 0.800 |
| −0.979 | 1.490 | 0.800 |
| −0.979 | 1.490 | 0.800 |
| −0.901 | 1.528 | 0.800 |
| −0.823 | 1.558 | 0.800 |
| −0.744 | 1.581 | 0.800 |
| −0.666 | 1.599 | 0.800 |
| −0.589 | 1.612 | 0.800 |
| −0.514 | 1.620 | 0.800 |
| −0.440 | 1.622 | 0.800 |
| −0.368 | 1.617 | 0.800 |
| −0.297 | 1.606 | 0.800 |
| −0.226 | 1.589 | 0.800 |
| −0.157 | 1.568 | 0.800 |
| −0.090 | 1.542 | 0.800 |
| −0.023 | 1.512 | 0.800 |
| 0.044 | 1.479 | 0.800 |
| 0.111 | 1.442 | 0.800 |
| 0.177 | 1.401 | 0.800 |
| 0.241 | 1.357 | 0.800 |
| 0.306 | 1.306 | 0.800 |
| 0.376 | 1.247 | 0.800 |
| 0.450 | 1.176 | 0.800 |
| 0.530 | 1.091 | 0.800 |
| 0.615 | 0.993 | 0.800 |
| 0.704 | 0.880 | 0.800 |
| 0.797 | 0.752 | 0.800 |
| 0.895 | 0.606 | 0.800 |
| 0.998 | 0.440 | 0.800 |
| 1.108 | 0.253 | 0.800 |
| 1.223 | 0.042 | 0.800 |
| 1.345 | −0.196 | 0.800 |
| 1.477 | −0.465 | 0.800 |
| 1.620 | −0.770 | 0.800 |
| 1.776 | −1.115 | 0.800 |
| 1.947 | −1.504 | 0.800 |
| 1.947 | −1.504 | 0.800 |
| 1.955 | −1.525 | 0.800 |
| 1.960 | −1.543 | 0.800 |
| 1.963 | −1.561 | 0.800 |
| 1.963 | −1.577 | 0.800 |
| 1.963 | −1.592 | 0.800 |
| 1.961 | −1.605 | 0.800 |
| 1.958 | −1.617 | 0.800 |
| 1.954 | −1.628 | 0.800 |
| 1.951 | −1.632 | 0.800 |
| 1.949 | −1.637 | 0.800 |
| 1.946 | −1.641 | 0.800 |
| 1.942 | −1.644 | 0.800 |

TABLE 1-continued

| X | Y | Z |
|---|---|---|
| 1.938 | −1.648 | 0.800 |
| 1.934 | −1.650 | 0.800 |
| 1.929 | −1.653 | 0.800 |
| 1.925 | −1.654 | 0.800 |
| 1.920 | −1.656 | 0.800 |
| 1.915 | −1.657 | 0.800 |
| 1.910 | −1.657 | 0.800 |
| 1.905 | −1.657 | 0.800 |
| 1.894 | −1.656 | 0.800 |
| 1.883 | −1.653 | 0.800 |
| 1.872 | −1.648 | 0.800 |
| 1.860 | −1.641 | 0.800 |
| 1.848 | −1.633 | 0.800 |
| 1.836 | −1.622 | 0.800 |
| 1.824 | −1.609 | 0.800 |
| 1.812 | −1.594 | 0.800 |
| 1.801 | −1.576 | 0.800 |
| 1.688 | −1.484 | 0.900 |
| 1.488 | −1.128 | 0.900 |
| 1.306 | −0.812 | 0.900 |
| 1.138 | −0.529 | 0.900 |
| 0.984 | −0.274 | 0.900 |
| 0.842 | −0.045 | 0.900 |
| 0.710 | 0.159 | 0.900 |
| 0.587 | 0.341 | 0.900 |
| 0.471 | 0.504 | 0.900 |
| 0.363 | 0.649 | 0.900 |
| 0.263 | 0.778 | 0.900 |
| 0.169 | 0.891 | 0.900 |
| 0.081 | 0.990 | 0.900 |
| −0.003 | 1.075 | 0.900 |
| −0.082 | 1.146 | 0.900 |
| −0.156 | 1.207 | 0.900 |
| −0.227 | 1.256 | 0.900 |
| −0.293 | 1.297 | 0.900 |
| −0.355 | 1.329 | 0.900 |
| −0.413 | 1.354 | 0.900 |
| −0.465 | 1.373 | 0.900 |
| −0.513 | 1.386 | 0.900 |
| −0.557 | 1.396 | 0.900 |
| −0.600 | 1.402 | 0.900 |
| −0.642 | 1.405 | 0.900 |
| −0.684 | 1.406 | 0.900 |
| −0.727 | 1.404 | 0.900 |
| −0.769 | 1.400 | 0.900 |
| −0.769 | 1.400 | 0.900 |
| −0.804 | 1.398 | 0.900 |
| −0.837 | 1.397 | 0.900 |
| −0.868 | 1.400 | 0.900 |
| −0.898 | 1.404 | 0.900 |
| −0.927 | 1.410 | 0.900 |
| −0.956 | 1.417 | 0.900 |
| −0.982 | 1.427 | 0.900 |
| −1.004 | 1.438 | 0.900 |
| −1.022 | 1.450 | 0.900 |
| −1.036 | 1.463 | 0.900 |
| −1.047 | 1.477 | 0.900 |
| −1.055 | 1.492 | 0.900 |
| −1.060 | 1.508 | 0.900 |
| −1.062 | 1.524 | 0.900 |
| −1.061 | 1.540 | 0.900 |
| −1.058 | 1.557 | 0.900 |
| −1.052 | 1.575 | 0.900 |
| −1.044 | 1.592 | 0.900 |
| −1.033 | 1.609 | 0.900 |
| −1.021 | 1.625 | 0.900 |
| −1.006 | 1.640 | 0.900 |
| −0.989 | 1.655 | 0.900 |
| −0.969 | 1.671 | 0.900 |
| −0.943 | 1.687 | 0.900 |
| −0.912 | 1.703 | 0.900 |
| −0.878 | 1.717 | 0.900 |
| −0.843 | 1.728 | 0.900 |
| −0.843 | 1.728 | 0.900 |
| −0.766 | 1.744 | 0.900 |
| −0.690 | 1.754 | 0.900 |
| −0.616 | 1.758 | 0.900 |
| −0.542 | 1.758 | 0.900 |

TABLE 1-continued

| X | Y | Z |
|---|---|---|
| −0.468 | 1.754 | 0.900 |
| −0.396 | 1.745 | 0.900 |
| −0.326 | 1.730 | 0.900 |
| −0.259 | 1.709 | 0.900 |
| −0.193 | 1.683 | 0.900 |
| −0.130 | 1.651 | 0.900 |
| −0.068 | 1.617 | 0.900 |
| −0.008 | 1.579 | 0.900 |
| 0.052 | 1.539 | 0.900 |
| 0.112 | 1.496 | 0.900 |
| 0.172 | 1.449 | 0.900 |
| 0.230 | 1.400 | 0.900 |
| 0.287 | 1.348 | 0.900 |
| 0.345 | 1.290 | 0.900 |
| 0.406 | 1.224 | 0.900 |
| 0.472 | 1.147 | 0.900 |
| 0.543 | 1.058 | 0.900 |
| 0.618 | 0.957 | 0.900 |
| 0.697 | 0.843 | 0.900 |
| 0.779 | 0.715 | 0.900 |
| 0.867 | 0.572 | 0.900 |
| 0.961 | 0.410 | 0.900 |
| 1.060 | 0.230 | 0.900 |
| 1.165 | 0.028 | 0.900 |
| 1.278 | −0.197 | 0.900 |
| 1.399 | −0.451 | 0.900 |
| 1.531 | −0.736 | 0.900 |
| 1.675 | −1.055 | 0.900 |
| 1.834 | −1.413 | 0.900 |
| 1.834 | −1.413 | 0.900 |
| 1.841 | −1.434 | 0.900 |
| 1.846 | −1.452 | 0.900 |
| 1.849 | −1.470 | 0.900 |
| 1.850 | −1.486 | 0.900 |
| 1.850 | −1.501 | 0.900 |
| 1.848 | −1.514 | 0.900 |
| 1.845 | −1.526 | 0.900 |
| 1.841 | −1.536 | 0.900 |
| 1.839 | −1.541 | 0.900 |
| 1.836 | −1.546 | 0.900 |
| 1.833 | −1.550 | 0.900 |
| 1.829 | −1.553 | 0.900 |
| 1.825 | −1.556 | 0.900 |
| 1.821 | −1.559 | 0.900 |
| 1.817 | −1.562 | 0.900 |
| 1.812 | −1.563 | 0.900 |
| 1.807 | −1.565 | 0.900 |
| 1.802 | −1.566 | 0.900 |
| 1.797 | −1.566 | 0.900 |
| 1.792 | −1.566 | 0.900 |
| 1.782 | −1.565 | 0.900 |
| 1.771 | −1.562 | 0.900 |
| 1.759 | −1.557 | 0.900 |
| 1.747 | −1.550 | 0.900 |
| 1.735 | −1.541 | 0.900 |
| 1.723 | −1.531 | 0.900 |
| 1.711 | −1.518 | 0.900 |
| 1.699 | −1.503 | 0.900 |
| 1.688 | −1.484 | 0.900 |
| 1.575 | −1.396 | 1.000 |
| 1.384 | −1.055 | 1.000 |
| 1.205 | −0.742 | 1.000 |
| 1.037 | −0.451 | 1.000 |
| 1.037 | −0.451 | 1.000 |
| 0.894 | −0.207 | 1.000 |
| 0.762 | 0.011 | 1.000 |
| 0.641 | 0.207 | 1.000 |
| 0.528 | 0.382 | 1.000 |
| 0.423 | 0.539 | 1.000 |
| 0.326 | 0.681 | 1.000 |
| 0.235 | 0.808 | 1.000 |
| 0.149 | 0.922 | 1.000 |
| 0.069 | 1.024 | 1.000 |
| −0.007 | 1.115 | 1.000 |
| −0.079 | 1.195 | 1.000 |
| −0.147 | 1.264 | 1.000 |
| −0.211 | 1.324 | 1.000 |
| −0.272 | 1.375 | 1.000 |

TABLE 1-continued

| X | Y | Z |
|---|---|---|
| −0.329 | 1.419 | 1.000 |
| −0.384 | 1.456 | 1.000 |
| −0.434 | 1.486 | 1.000 |
| −0.479 | 1.510 | 1.000 |
| −0.521 | 1.530 | 1.000 |
| −0.561 | 1.546 | 1.000 |
| −0.601 | 1.561 | 1.000 |
| −0.643 | 1.573 | 1.000 |
| −0.643 | 1.573 | 1.000 |
| −0.662 | 1.578 | 1.000 |
| −0.681 | 1.582 | 1.000 |
| −0.700 | 1.586 | 1.000 |
| −0.719 | 1.589 | 1.000 |
| −0.719 | 1.589 | 1.000 |
| −0.734 | 1.592 | 1.000 |
| −0.750 | 1.596 | 1.000 |
| −0.767 | 1.601 | 1.000 |
| −0.786 | 1.607 | 1.000 |
| −0.806 | 1.614 | 1.000 |
| −0.828 | 1.624 | 1.000 |
| −0.851 | 1.635 | 1.000 |
| −0.851 | 1.635 | 1.000 |
| −0.880 | 1.651 | 1.000 |
| −0.907 | 1.670 | 1.000 |
| −0.931 | 1.691 | 1.000 |
| −0.951 | 1.714 | 1.000 |
| −0.964 | 1.736 | 1.000 |
| −0.972 | 1.757 | 1.000 |
| −0.976 | 1.778 | 1.000 |
| −0.976 | 1.799 | 1.000 |
| −0.972 | 1.820 | 1.000 |
| −0.963 | 1.842 | 1.000 |
| −0.950 | 1.862 | 1.000 |
| −0.932 | 1.882 | 1.000 |
| −0.910 | 1.901 | 1.000 |
| −0.886 | 1.917 | 1.000 |
| −0.859 | 1.932 | 1.000 |
| −0.829 | 1.945 | 1.000 |
| −0.798 | 1.955 | 1.000 |
| −0.766 | 1.962 | 1.000 |
| −0.733 | 1.967 | 1.000 |
| −0.700 | 1.968 | 1.000 |
| −0.700 | 1.968 | 1.000 |
| −0.615 | 1.964 | 1.000 |
| −0.531 | 1.951 | 1.000 |
| −0.447 | 1.931 | 1.000 |
| −0.365 | 1.905 | 1.000 |
| −0.285 | 1.871 | 1.000 |
| −0.208 | 1.830 | 1.000 |
| −0.134 | 1.782 | 1.000 |
| −0.063 | 1.728 | 1.000 |
| 0.007 | 1.670 | 1.000 |
| 0.074 | 1.607 | 1.000 |
| 0.141 | 1.539 | 1.000 |
| 0.206 | 1.469 | 1.000 |
| 0.270 | 1.395 | 1.000 |
| 0.332 | 1.317 | 1.000 |
| 0.393 | 1.236 | 1.000 |
| 0.452 | 1.154 | 1.000 |
| 0.509 | 1.070 | 1.000 |
| 0.567 | 0.982 | 1.000 |
| 0.627 | 0.885 | 1.000 |
| 0.692 | 0.777 | 1.000 |
| 0.763 | 0.655 | 1.000 |
| 0.839 | 0.518 | 1.000 |
| 0.920 | 0.365 | 1.000 |
| 1.008 | 0.197 | 1.000 |
| 1.008 | 0.197 | 1.000 |
| 1.229 | −0.251 | 1.000 |
| 1.465 | −0.758 | 1.000 |
| 1.720 | −1.325 | 1.000 |
| 1.720 | −1.325 | 1.000 |
| 1.728 | −1.345 | 1.000 |
| 1.733 | −1.364 | 1.000 |
| 1.736 | −1.381 | 1.000 |
| 1.737 | −1.397 | 1.000 |
| 1.737 | −1.411 | 1.000 |
| 1.735 | −1.425 | 1.000 |

TABLE 1-continued

| X | Y | Z |
|---|---|---|
| 1.732 | −1.437 | 1.000 |
| 1.728 | −1.448 | 1.000 |
| 1.723 | −1.457 | 1.000 |
| 1.720 | −1.461 | 1.000 |
| 1.716 | −1.464 | 1.000 |
| 1.713 | −1.468 | 1.000 |
| 1.708 | −1.470 | 1.000 |
| 1.704 | −1.473 | 1.000 |
| 1.700 | −1.475 | 1.000 |
| 1.695 | −1.476 | 1.000 |
| 1.690 | −1.477 | 1.000 |
| 1.680 | −1.478 | 1.000 |
| 1.669 | −1.476 | 1.000 |
| 1.658 | −1.473 | 1.000 |
| 1.646 | −1.468 | 1.000 |
| 1.634 | −1.461 | 1.000 |
| 1.622 | −1.453 | 1.000 |
| 1.610 | −1.442 | 1.000 |
| 1.598 | −1.430 | 1.000 |
| 1.586 | −1.414 | 1.000 |
| 1.575 | −1.396 | 1.000 |

Although a preferred embodiment of this invention has been disclosed, a worker of ordinary skill in this art would recognize that certain modifications would come within the scope of this invention. For that reason, the following claims should be studied to determine the true scope and content of this invention. Since many possible embodiments may be made of the invention without departing from the scope thereof, it is to be understood that all matter herein set forth or shown in the accompanying drawings is to be interpreted as illustrative and not in a limiting sense.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. A turbine blade comprising:

a blade root;

a platform extending from the blade root;

an airfoil extending from the platform to a tip and having an airfoil shape, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape; and, a shroud extending from the airfoil tip.

2. The turbine blade of claim 1 forming a part of a second stage turbine of a gas turbine engine.

3. The turbine blade of claim 1, wherein the airfoil has a height as measured from a midpoint of the platform to a tip of the airfoil of approximately 14.147 inches.

4. The turbine blade of claim 1 further comprising a coating applied to at least the airfoil.

5. The turbine blade of claim 1, wherein the shroud further comprises a plurality of knife edges extending away from the shroud, opposite the airfoil.

6. The turbine blade of claim 1, wherein the X, Y, and Z values are scalable as a function of one or more constants.

7. A turbine blade comprising:

a blade root;

a platform extending from the blade root;

an airfoil extending from the platform, the airfoil having an airfoil shape within an envelope of approximately −0.032 to +0.032 inches in a direction normal to any surface of the airfoil, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape, and, a shroud extending from the airfoil tip.

8. The turbine blade of claim 7 forming a part of a second stage turbine of a gas turbine engine.

9. The turbine blade of claim 7 further comprising a coating applied to the airfoil.

10. The turbine blade of claim 7, wherein the shroud further comprises a plurality of knife edges extending away from the shroud, opposite the airfoil.

11. The turbine blade of claim 7, wherein the X, Y, and Z values are scalable as a function of one or more constants.

12. A turbine comprising:

a turbine wheel positioned along an engine centerline;

a plurality of turbine blades secured to the turbine wheel, each turbine blade comprising:

a blade root;

a platform extending radially outward from the blade root;

an airfoil extending radially outward from the platform, the airfoil having an airfoil tip and an airfoil shape, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape; and, a shroud extending from the airfoil tip.

13. The turbine of claim 12 forming a part of a second stage of a gas turbine engine.

14. The turbine of claim 12, wherein the turbine blade further comprises a coating applied to at least the airfoil.

15. The turbine blade of claim 12, wherein the shroud further comprises a plurality of knife edges extending away from the shroud, opposite the airfoil.

16. The turbine blade of claim 12, wherein the X, Y, and Z values are scalable as a function of one or more constants.

17. A turbine comprising:

a turbine wheel positioned along an engine centerline;

a plurality of turbine blades secured to the turbine wheel, each turbine blade comprising:

a blade root;

a platform extending radially outward from the blade root;

an airfoil extending radially outward from the platform, the airfoil having an airfoil tip and an airfoil shape within an envelope of approximately −0.032 to +0.032 inches in a direction normal to any surface location of the airfoil, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape; and, a shroud extending from the airfoil tip.

18. The turbine of claim 17 forming a part of a second stage of a gas turbine engine.

19. The turbine of claim 17, wherein the turbine blade further comprises a coating applied to at least the airfoil.

20. The turbine blade of claim 17, wherein the shroud further comprises a plurality of knife edges extending away from the shroud, opposite the airfoil.

21. The turbine blade of claim 17, wherein the X, Y, and Z values are scalable as a function of one or more constants.

* * * * *